US005145164A

United States Patent [19]

Kan

[11] Patent Number: 5,145,164

[45] Date of Patent: Sep. 8, 1992

[54] SHEET FEEDING APPARATUS

[75] Inventor: Shoichi Kan, Yokohama, Japan

[73] Assignee: Canon Kabushiki Kaisha, Tokyo, Japan

[21] Appl. No.: 825,326

[22] Filed: Jan. 27, 1992

Related U.S. Application Data

[63] Continuation of Ser. No. 479,153, Feb. 13, 1990, abandoned.

[30] Foreign Application Priority Data

| | | | |
|---|---|---|---|
| Feb. 14, 1989 | [JP] | Japan | 1-034574 |
| Mar. 8, 1989 | [JP] | Japan | 1-057309 |
| May 31, 1989 | [JP] | Japan | 1-135841 |
| May 31, 1989 | [JP] | Japan | 1-135846 |
| May 31, 1989 | [JP] | Japan | 1-135847 |

[51] Int. Cl.[5] ..... B65H 7/12; B65H 3/54

[52] U.S. Cl. ..... 271/170; 271/262; 271/265; 271/171

[58] Field of Search ..... 271/110, 121, 262, 263, 271/265, 266, 170, 171

[56] References Cited

U.S. PATENT DOCUMENTS

| | | | |
|---|---|---|---|
| 3,339,916 | 9/1967 | Tregay | 271/170 |
| 3,531,106 | 9/1970 | Larson et al. | 271/36 |
| 3,807,725 | 4/1974 | Bookless | 271/170 |
| 4,032,136 | 6/1977 | Komaba et al. | 271/170 |
| 4,492,371 | 1/1985 | Kan et al. | 271/21 |
| 4,623,138 | 11/1986 | Sakamaki et al. | 271/170 |
| 4,635,919 | 1/1987 | Habich et al. | 271/170 |
| 4,647,030 | 3/1987 | Tomita | 271/170 |
| 4,653,743 | 3/1987 | Ebata et al. | 271/124 |
| 4,828,245 | 5/1989 | Shimogawara | 271/170 |

FOREIGN PATENT DOCUMENTS

| | | | |
|---|---|---|---|
| 313225 | 12/1989 | Japan | 271/124 |
| 1306595 | 2/1973 | United Kingdom . | |

*Primary Examiner*—Robert P. Olszewski
*Assistant Examiner*—Steven M. Reiss
*Attorney, Agent, or Firm*—Fitzpatrick, Cella, Harper & Scinto

[57] ABSTRACT

The present invention provides a sheet feeding apparatus having a support on which sheets are supported in a sheet stack, at least one separating claw arranged adjacent a corner of a front end of the sheet stack supported on the support and having a pawl portion for pressing down an upper surface of the sheet stack and an abutment portion against which the front end of the sheet stack is abutted, a slit provided between the pawl portion and the abutment portion of the support for permitting the passage of only one sheet having a predetermined thickness, a guide for selectively positioning lateral edges of the sheet stack supported on the support between a first position where an uppermost sheet on the sheet stack can pass through the slit and a second position where the uppermost sheet is blocked by the separating claw, and a supply mechanism for feeding the sheet stacked on the support.

23 Claims, 17 Drawing Sheets

| |
|---|
| FIG. 25A |
| FIG. 25B |

SHEET FEEDING APPARATUS

This application is a continuation of application Ser. No. 07/479,153 filed Feb. 13, 1990 now abandoned.

BACKGROUND OF THE INVENTION

1. Field of the Invention

The present invention relates to a sheet feeding apparatus wherein stacked sheets are separated by separating claws and are fed one by one.

2. Related Background Art

In recording systems such as printers, copying machines and the like, or in original reading systems, a cut sheet feeder has been used to separate a sheet (including an original such as a printed matter, as well as a recording medium such as a paper) from a sheet stack one by one to be fed successively.

As disclosed in the U.S. Pat. Nos. 3,531,106, 4,4492,371 and 4,653,743, various types of sheet separating mechanisms have been proposed, one of which utilizes separating claws. The present invention is directed to a sheet feeding apparatus including such separating claws.

FIG. 26 shows a plan view of a conventional separating claw and FIG. 27 shows an elevational view of the separating claw of FIG. 26.

Referring to FIGS. 26 and 27, in a sheet feeding apparatus, a number of sheets (plain sheets) 11 are stacked on pressure plates 12 and the sheet stack is pressed against sheet supply rollers 14 by biasing the pressure plates 12 upwardly by means of bias springs 13. Separating claws 15 are arranged at both corners of the front end of the sheet stack 11, by which the uppermost sheet 11 is separated from the sheet stack one by one when the frictional feeding force of the supply rollers 14 is created.

The separating claws 15 and the supply rollers 14 are paired, respectively, and are arranged symmetrically with respect to a sheet feeding direction, respectively. Only one (left side one) of these elements 15, 14 are shown in FIGS. 26 and 27.

Each separating claw 15 has a pawl portion 16 for holding down an upper surface of the sheet stack 11 and an abutment portion 17 against which the front end of the sheet stack 11 is abutted. The separating claws are constituted by discrete members each other and are arranged at left and right sides of a front end of a frame of the sheet feeding apparatus integrally therewith or pivotably for up-and-down movement.

FIGS. 28A, 28B and 28C show schematically, in sectional view, three stages of the sheet separating and feeding method performed by the separating claws with respect to the sheets 11.

In FIG. 28A, the sheets 11 are in a condition that the sheets stacked on the pressure plates 12 are pressed against the supply rollers 14 by the bias springs 13. In this condition, the supply rollers 14 are rotated in the direction shown by the arrow in response to a sheet feed command signal. When the supply rollers 14 are rotated, a thrust force due to the friction force is applied on the sheet stack 11.

On the other hand, at the both sides of the front end of the sheet stack, the upper surface of the sheet stack is pressed down by the pawl portions 16 and the front end of the sheet stack is abutted against the abutment portion 17. Accordingly, as shown in FIG. 28B, the uppermost sheet on the sheet stack 11 is bent to form a loop between the pawl portions 16 and the supply rollers 14.

When the supply rollers 14 are further rotated until a predetermined amount of the loop is obtained, the uppermost sheet 11 will ride over the pawl portions 16 due to the elastic restoring force of the sheet itself, so that it is fed toward a sheet feeding direction as shown in FIG. 28C, thus separating the uppermost sheet from the sheet stack 11. The separated sheet 11 is fed by the supply rollers 14 until it is abutted against feed rollers provided in a recording portion of a recording system, and thereafter, the sheet is fed to a predetermined position in the recording portion, thus preparing for a recording operation and the like.

However, in the conventional claw separating mechanism, for example, if thicker sheet having high rigidity such as a postcard, drawing paper and the like is used, the loop (as shown in FIG. 28B) cannot be created in the sheet since the feeding force (friction force) of the supply rollers cannot overcome the hardness to be bent (of the sheet), with the result that the sheet cannot ride over the separating pawl portions 16.

Consequently, in the conventional sheet feeding apparatus, the automatic feeding of both the normal sheet (such as the plain paper) and the thicker sheet (such as a postcard) could not be attained, unless both a sheet feeding apparatus for the normal sheet and a sheet feeding apparatus for the thicker sheet are provided or unless a thicker sheet holder including a thicker sheet separating mechanism is arranged in the normal sheet feeding apparatus.

SUMMARY OF THE INVENTION

An object of the present invention is to provide a sheet feeding apparatus which can eliminate the above-mentioned conventional drawbacks and which can automatically separate and feed both the normal sheets and the thicker sheets with a simple construction including only one set of separating claws.

According to the present invention, the above object is achieved by providing a sheet feeding apparatus adapted to separate and feed sheets one by one with a friction force, which has a structure capable of separating and feeding the normal sheets and thicker sheets by means of only one set of separating claws arranged at both sides of the front end of a sheet stack and each having a pawl portion for holding down the upper surface of the sheet stack and an abutment portion against which the front end of the sheet is abutted, wherein a slit having a dimension permitting the passage of only one thicker sheet is formed in each separating claw between its pawl portion and abutment portion, and side guides are removably or retractably provided for guiding both side edge portions of plural stacked thicker sheets.

BRIEF DESCRIPTION OF THE DRAWINGS

FIG. 1A depicts a condition that normal sheets are used, and FIG. 1B depicts a condition that thicker sheets are used;

DETAILED DESCRIPTION OF THE PREFERRED EMBODIMENTS

The present invention will now be explained in connection with embodiments thereof with reference to the accompanying drawings.

First of all, a first embodiment of the present invention will be explained with reference to FIGS. 1 to 8.

Figure 1A:
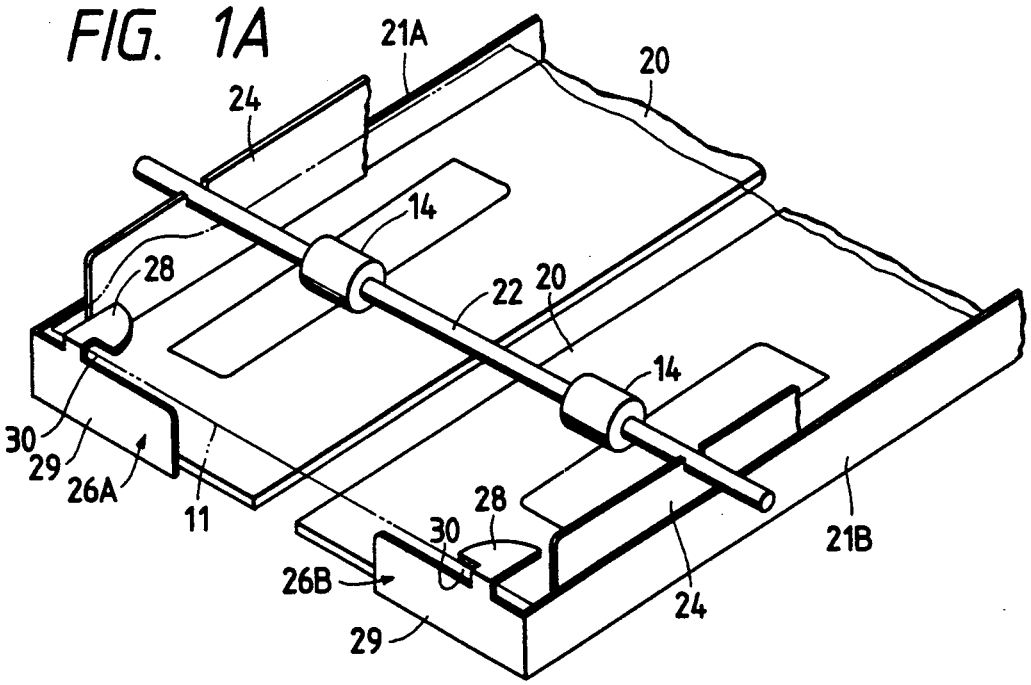
FIGS. 1A and 1B are perspective views of a sheet feeding apparatus according to a preferred embodiment of the present invention, where
Figure 1B:
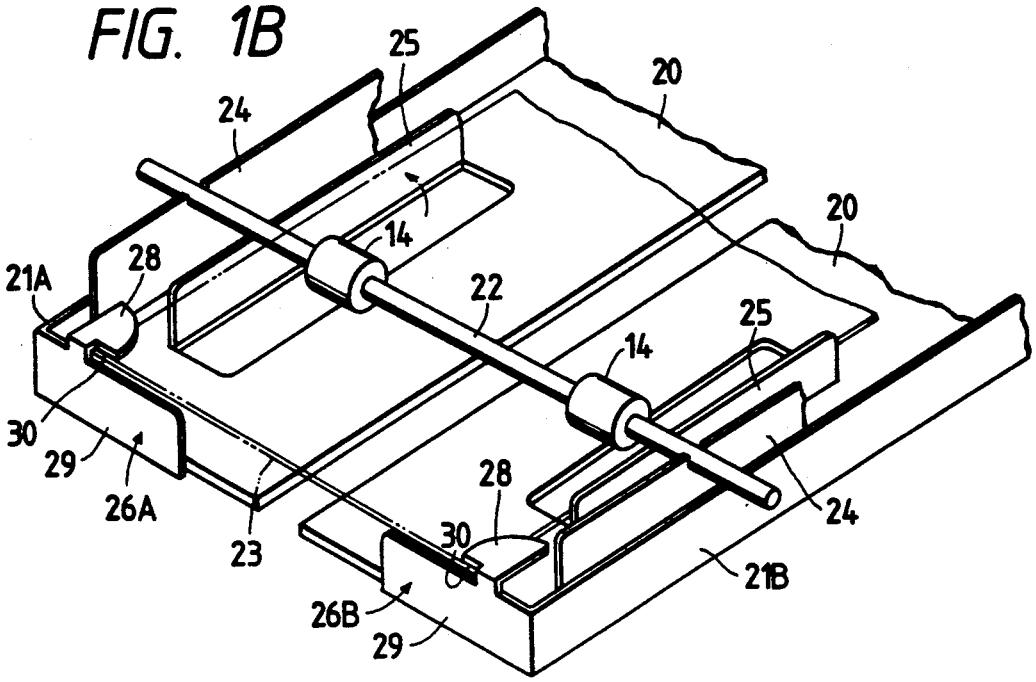
Figure 2:
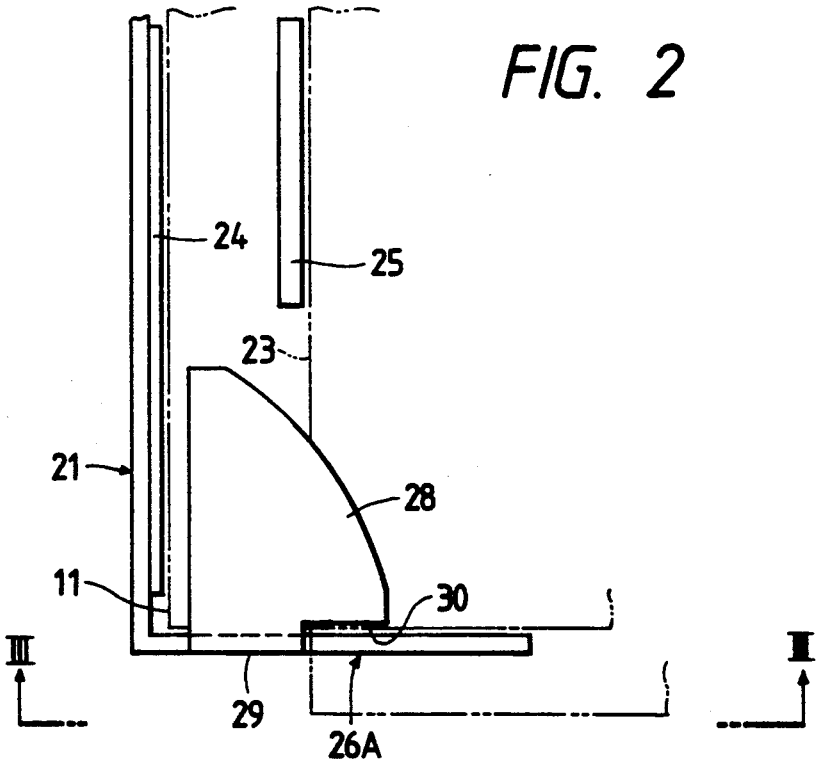
FIG. 2 is a schematic plan view of a separating claw of the apparatus of FIGS. 1A and 1B.

FIG. 1 shows a schematic perspective view of a sheet feeding apparatus according to the first embodiment of the present invention, where FIG. 1A depicts a condition that normal sheets are used, and FIG. 1B depicts a condition that thicker sheets are used. FIG. 2 is a schematic partial plan view showing a detail of the left (in FIG. 1) separating claw, and FIG. 3 is a schematic partial elevational view observed at along the line III—III of FIG. 2.

Figure 3:
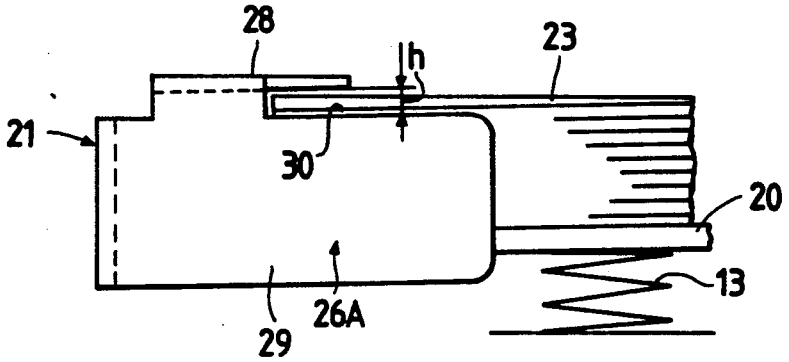
FIG. 3 is a schematic elevational view of the separating claw observed at along the line III—III of FIG. 2.

In FIGS. 1 to 3, the sheet feeding apparatus comprises a frame 21 divided into a left half portion 21A and a right half portion 21B, so that the whole width of the frame 21 can be adjusted by shifting these half portions along a shaft (such as a shaft on which sheet supply rollers 14 are mounted) passing through the frame.

A number of sheets (normal sheets 11 or thicker sheets 23) are supported, in a stack, on pressure plates 20 arranged within the frame 21. The upper surface of the sheet stack supported on the pressure plates is pressed against the supply rollers 14 by biasing the pressure plates 20 toward the supply rollers 14 by means of bias springs 13.

Normal sheet guiding side guides 24 are arranged on side walls of the left and right frame half portions 21A and 21B, respectively, and thicker sheet guiding side guides 25 are removably or retractably arranged on the respective pressure plates 20 or on the respective frame half portions 21A, 21B, inside the respective side guides 24.

In the embodiment shown in FIGS. 1 and 2, the thicker sheet guiding side guides 25 are provided on the respective frame half portions 21A, 21B or on the pressure plates 20 in such a manner that such side guides can be cocked from the half portions or pressure plates and also can be laid in flush with the half portions or pressure plates to form a single plane together with the latter.

On an outer side of a front end of each of the frame half portions 21A and 21B, separating claws 26A and 26B are provided, respectively, for separating the uppermost sheet from the sheet stack during the sheet feeding operation. In the illustrated embodiment, the separating claws 26A and 26B are formed integrally with the corresponding frame half portions 21A and 21B, and each has a pawl portion 28 and an abutment portion 29.

The sheet feeding apparatus shown in FIGS. 1 to 3 has a construction formed symmetrically with respect to a longitudinal axis or line of the apparatus.

Each separating claw 26A, 26B has the pawl portion 28 and the abutment portion 29, and a slit 30 having a width permitting the passage of only one thicker sheet is formed between the pawl portion 28 and the abutment portion 29. The slit 30 has a length substantially equal to a half of the transverse length of the pawl portion 28, and the transverse length and the width of each slit 30 are so selected that only the uppermost thicker-sheet 23 guided by the side guides 25 can smoothly pass through the slit in the sheet feeding direction, as shown in FIGS. 2 and 3.

Figure 28A:
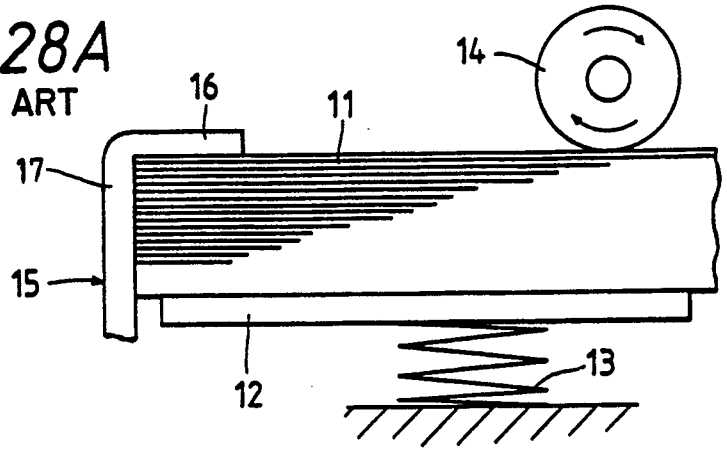
FIG. 28A PRIOR ART
FIGS. 28A to 28C are sectional views showing the condition that the normal sheets are separated and fed by the separating claws.
Figure 28B:
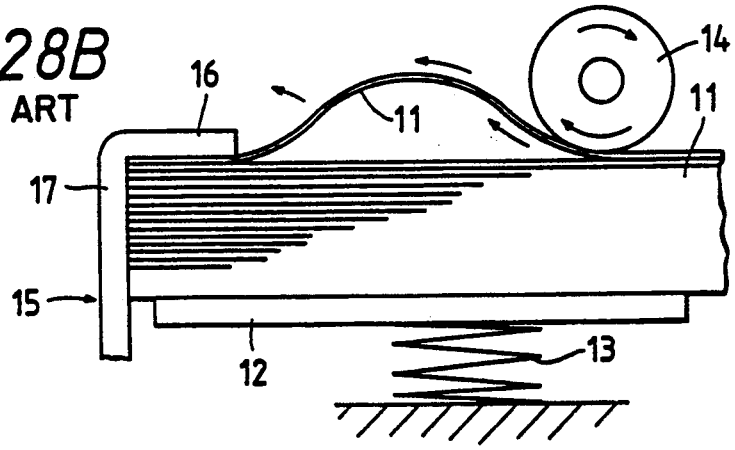
FIG. 28B PRIOR ART
Figure 28C:
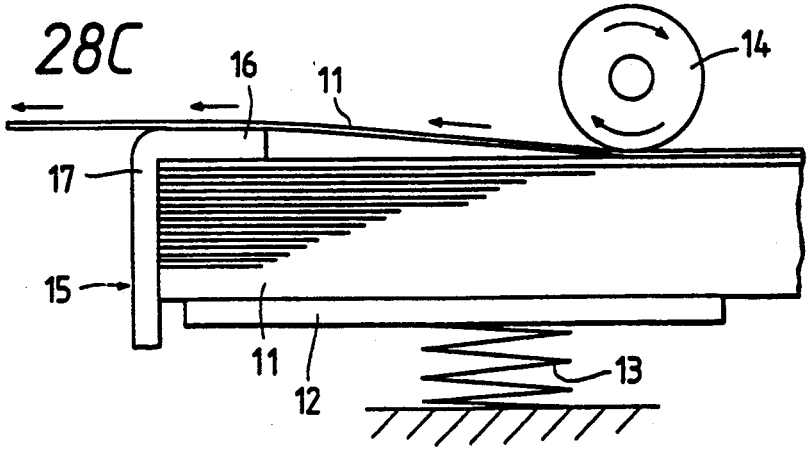
FIG. 28C PRIOR ART

When the normal sheet 11 is fed by using the sheet feeding apparatus as mentioned in connection with FIGS. 1 to 3, after the inner thicker sheet guiding side guides are removed or retracted into a non-used condition (FIG. 1A), the normal sheets 11 are stacked on the pressure plates 20. Then, the sheet stack is pressed against the supply rollers 14 by means of the bias springs 13. In this condition, the supply rollers 14 are activated. In this case, since the normal sheet stack 11 is pressed down at its front end corners by means of the pawl portions 28 and is also abutted at its front end against the abutment portions 29, the normal sheet 11 can be fed one by one in the same manner as the conventional claw separation method described in connection with FIG. 28.

On the other hand, when each recording sheet in the sheet stack comprises a thicker sheet 23 having the high rigidity such as a postcard or a drawing paper, the thicker sheet guiding side guides 25 are cocked in a usable position (FIG. 1B), and the thicker sheets 23 are set on the pressure plates 20 in alignment with the side guides 25.

In this case, as shown in FIG. 2, the side guides 25 are positioned with respect to the separating claws 26A and 26B in such a manner that, when the thicker sheets 23 are set on the pressure plates, the front end of the uppermost sheet is not abutted against the abutment portions 29 and the upper surface of the uppermost thicker sheet is pressed against the undersurfaces of the pawl portions 28. In this condition, when the supply rollers 14 are rotated in response to a sheet feed command signal, the uppermost thicker sheet 23 is fed in the sheet feeding direction while being guided at its lateral edges by the side guides 25.

Figure 4:
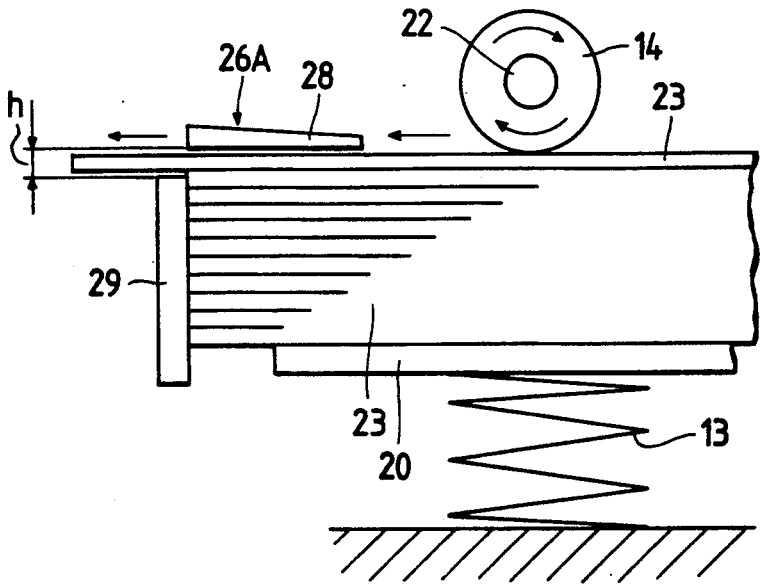
FIG. 4 is a sectional view showing a condition that the thicker sheet is fed in the apparatus shown in FIG. 1B.

FIG. 4 is a partial sectional view showing the condition that the thicker sheet is fed by the sheet feeding apparatus of FIGS. 1 to 3.

In FIG. 4, when the thicker sheet 23 is fed in the manner as mentioned above, since there are no abutment portions 29 in the sheet feeding path and the width (clearance) h of the each slit 30 formed between the pawl portion 28 and the abutment portion 29 is selected to pass only one thicker sheet 23 but not to pass two or more thicker sheets simultaneously, only the uppermost thicker sheet is separated from the sheet stack and is fed toward a recording portion of the recording system and the like.

According to the embodiment as mentioned above, by using only one set of the separating claws and with a simple construction, either the normal sheet 11 or the thicker sheet 23 can be positively separated and fed one by one.

Figure 5:
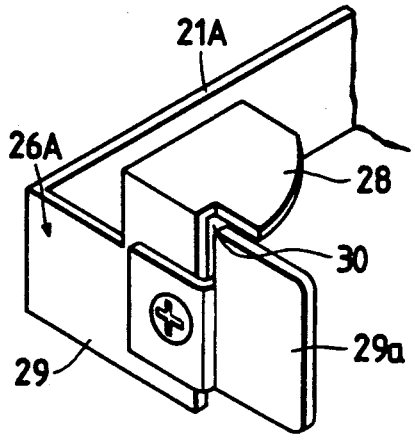
FIG. 5 is a perspective view showing an alteration of the separating claw of FIGS. 1A and 1B.

FIG. 5 shows an alteration of the separating claws 26A, 26B. In this case, a separate inner part 29*a* is removably assembled (by means of a screw and the like) to the abutment portion 29 to form the slit 30 between the abutment portion 29 and the pawl portion 28.

In this assembly, the accuracy of the dimension of the slit 30 which is difficult to obtain by making the claw with a single piece by stamping and bending operation can be easily improved by making the claw with two pieces and by assembling these two pieces to keep the slit with high accuracy. Further, by merely changing the shape of the separate part 29*a*, it is possible to easily change the dimension of the slit 30 to meet with the requirements for recording sheets having different thickness.

Figure 6:
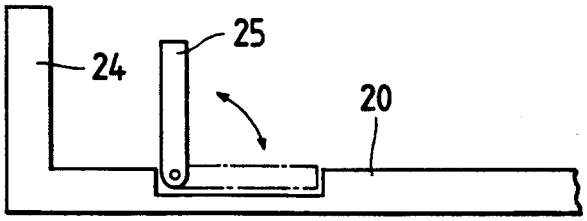
FIG. 6 is a cross-sectional view of a thicker sheet guiding side guide of the apparatus shown in FIG. 1B.

FIG. 6 shows one of the side guides 24, 25 of the apparatus of FIG. 1. The side guide 25 for the thicker sheet 23 is mounted on the corresponding pressure plate 20 in such a manner that the side guide can be cocked from and retracted within the pressure plate.

When the normal sheets 11 are used, the thicker sheet guiding side guides 25 are retracted within the pressure plate 20 in flush with the latter, as shown by the dot-and-chain line in FIG. 6, and then the normal sheets 11 are set on the pressure plates so that the side edges of the normal sheet are guided only by the outer side guides 24. When the thicker sheets 23 such as postcards and drawing papers having the high rigidity are used, the side guide 25 are cocked as shown by the solid line in FIG. 6.

Figure 7:
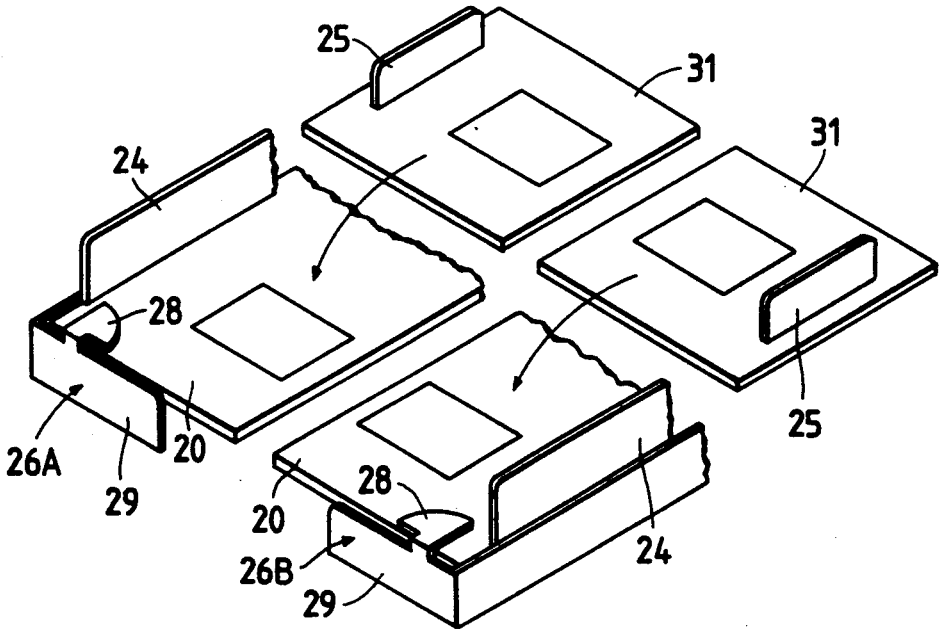
FIG. 7 is an exploded perspective view showing an example of a removable thicker sheet guiding side guide.

FIG. 7 is an exploded perspective view of the sheet feeding apparatus wherein the side guides 23 for the thicker sheet 23 are removably mounted.

In FIG. 7, pressure plates 31 on which the thicker sheets 23 are stacked are provided independently of the pressure plates 20 on which the normal sheets 11 are stacked, and the thicker sheet guiding side guides 25 are fixedly mounted on the respective pressure plates 31. When the normal sheets 11 are used, the pressure plates 31 are removed from the sheet feeding apparatus, whereas, when the thicker sheets 23 are used, the pressure plates 31 with the side guides 25 are attached onto the corresponding pressure plates 20 in place.

Figure 8:
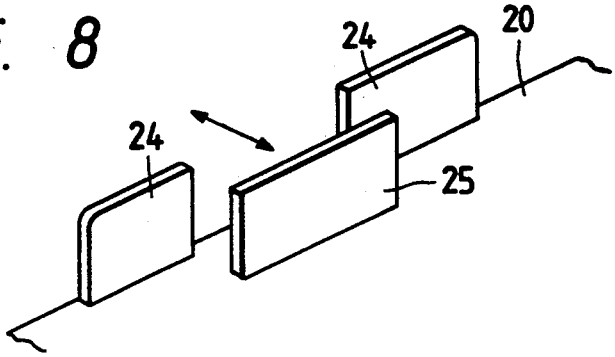
FIG. 8 is a perspective view showing another example of the removable thicker sheet guiding side guide.

FIG. 8 shows an alteration of the thicker sheet guiding side guide 25, wherein the normal sheet guiding side guide 24 formed on the outer lateral edge of the corresponding pressure plate 20 is so designed that a portion 25 of the side guide 24 can be slid by a predetermined distance in the transverse direction of the side guide. When the thicker sheets 23 are used, as shown in FIG. 8, the slidable portion 25 is slidably shifted inwardly to form the thicker sheet guiding side guide 25, whereas, when the normal sheets 11 are used, the slidable portion is retracted to cooperate with the remaining portions of the side guide 24, thereby completing the whole normal sheet guiding side guide 24.

Incidentally, in FIG. 5, if the separate part 29*a* of the abutment portion 29 can be adjusted in an up-and-down direction by an operator, it is possible to adjust the width h of the slit 30 defined between the separate part 29*a* and the pawl portion 28, thus permitting the use of the sheets having the different thickness.

Next, a second embodiment of the present invention will be explained.

In this second embodiment, the shape or configuration of the separating claw 26 differs from that of the previous or first embodiment.

Figure 9:
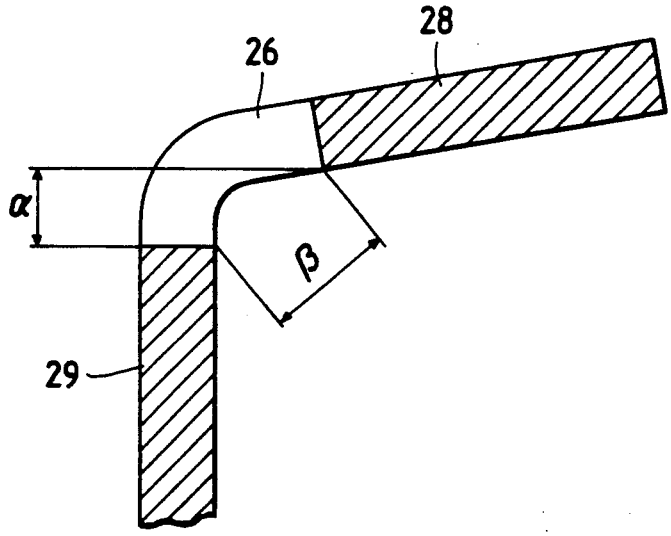
FIG. 9 is a sectional view showing a slit portion of the separating claw.

FIG. 9 is a sectional view of a separating claw, for explaining the formation of the slit in the sheet feeding apparatus according to the second embodiment.

In FIG. 9, the separating claw 26 has a pawl portion 28 and an abutment portion 29, and a slit is formed or defined between these portions 28, 29. The slit has a width $\alpha$ and a distance $\beta$ between the pawl portion 28 and the abutment portion 29, the distance $\beta$ being greater than the width $\alpha$. Further, the width of the slit is smaller than the thickness $\gamma$ of the thicker sheet to be automatically fed, and the distance $\beta$ between the pawl portion 28 and the abutment portion 29 is greater than the thickness $\gamma$ of the thicker sheet.

In the second embodiment, when the normal sheet 11 is fed, the inner thicker sheet guiding side guides 25 are removed or retracted in the non-used position, and then the normal sheets 11 are stacked on the pressure plates 20, and then the supply rollers 14 are rotated, in the same manner as already described in connection with FIGS. 6 to 8. That is to say, since the both corners of the front end of the sheet stack of the normal sheets 11 are held down by the pawl portions 28 and the front end of the sheet stack 11 is abutted against the abutment portions 29, the normal sheets 11 can be separated and fed one by one, in the same manner as the conventional sheet feeding method as mentioned in FIG. 28.

On the other hand, when the thicker sheets 23 such as the postcards or drawing papers are stacked, the thicker sheet guiding side guides 25 are mounted or cocked in the usable position, and then the thicker sheets 23 are set in alignment with the side guides 25.

Figure 10:
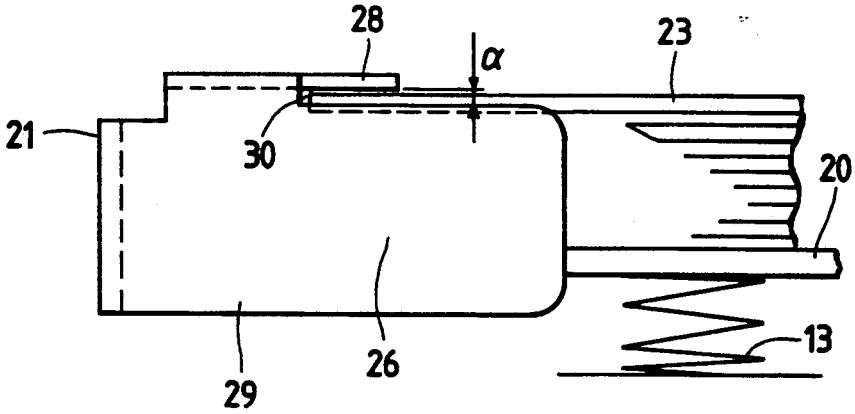
FIG. 10 is a plan view of a sheet feeding apparatus according to a second embodiment of the present invention.

In this case, as shown in FIG. 10, the side guides (25) are positioned with respect to the separating claws 26A (26B) in such a manner that, when the thicker sheets 23 are set, the front end of the uppermost sheet is not abutted against the abutment portions 29 and the upper surface of the uppermost sheet is pressed against the pawl portions 28.

When the supply rollers 14 are rotated in response to the sheet feed command signal, the uppermost thicker sheet 23 is fed in the sheet feeding direction while being guided at its lateral edges by the side guides 25.

Figure 11:
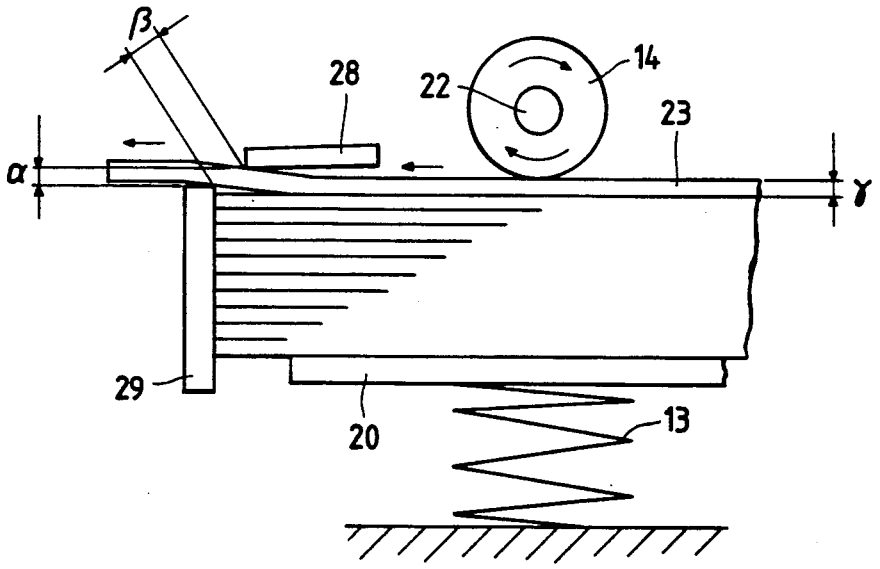
FIG. 11 is a sectional view of the sheet feeding apparatus of FIG. 10.

FIGS. 10 and 11 show, in sectional view, the condition that the thicker sheet 23 is fed.

In FIG. 11, when the thicker sheet 23 is fed in the manner as described above, there are the slits each having the width o defined by the corresponding pawl portion 28 and abutment portion 29 in front of the thicker sheet 23 in the sheet feeding direction. Since the width $\alpha$ of each slit is smaller than the thickness 65 of the thicker sheet 23, the thicker sheet 23 is slightly abutted against the upper edges of the abutment portions 29. When the thicker sheet 23 is further advanced by the supply rollers 14, since the distance $\beta$ between the pawl portion 28 and the abutment portion 29 is greater than the thickness $\gamma$ of the thicker sheet 23, only the uppermost sheet 23 overrides the upper edges of the abutment portions 29 to be separated from the sheet stack and is then fed toward the recording portion of the recording system.

If the distance $\beta$ is equal to or smaller than the width $\alpha$ of the slit, the sheet having the thickness larger than the width $\alpha$ will cause the erroneous feeding due to the bending of the sheet and the like. However, in the present invention, such erroneous feeding can be completely eliminated. Further, if the distance $\beta$ is the maximum clearance of the slit and is set to have a value smaller than the twice of the thickness of the sheet, more positive sheet separating ability will be attained.

As mentioned above, by setting the width $\alpha$ of each slit to have a value smaller than the thickness $\gamma$ of the thicker sheet and setting the distance $\beta$ between the pawl portion and the abutment portion to have a value larger than the thickness $\gamma$ of the thicker sheet, it is possible to separate the thicker sheet 23 from the sheet stack positively and to prevent the occurrence of the double-feeding.

According to the second embodiment as mentioned above, by using only one set of separating claws 26A, 26B and with a simple arrangement, both the normal sheets and the thicker sheets can be positively separated and fed one by one.

Incidentally, also in the second embodiment, it is possible to adopt the alterations shown in FIGS. 5 to 8, as in the previous first embodiment.

Next, a third embodiment of the present invention will be explained.

Figure 12:
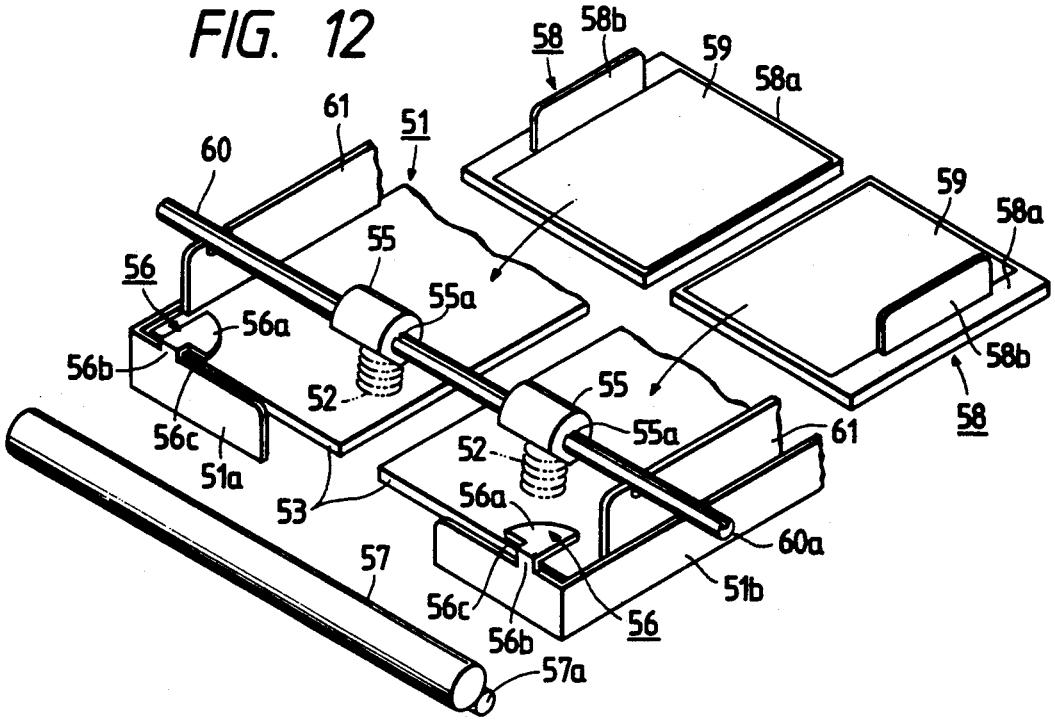
FIG. 12 is an exploded perspective view of a sheet feeding apparatus according to a third embodiment of the present invention.
Figure 13:
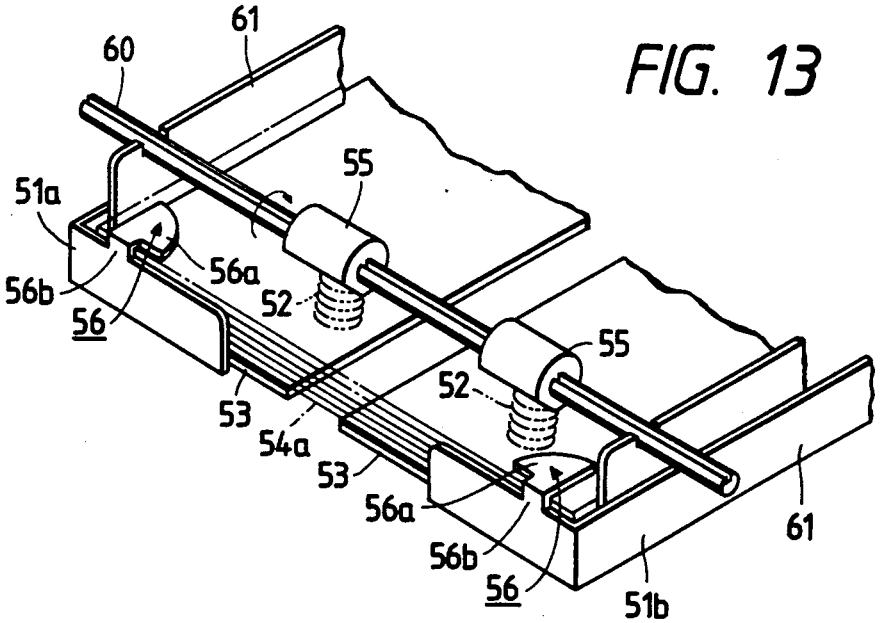
FIG. 13 is a perspective view of the apparatus of FIG. 12, explaining the feeding of the normal sheet.
Figure 14:
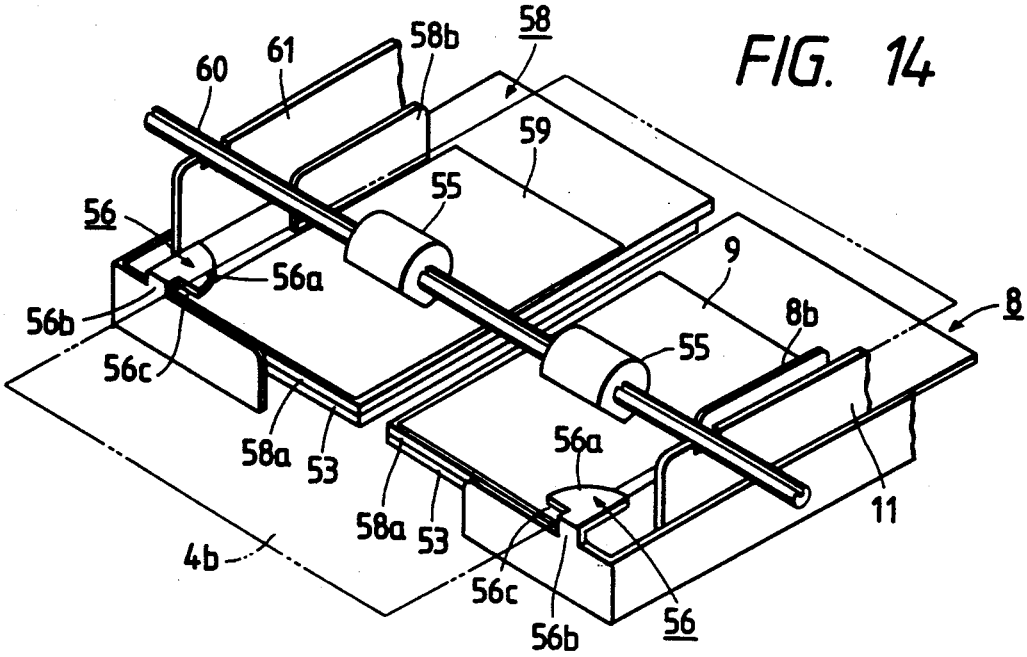
FIG. 14 is a perspective view of the apparatus of FIG. 12, explaining the feeding of the thicker sheet.

FIG. 12 is a perspective view of a sheet feeding apparatus according to a third embodiment of the present invention, FIG. 13 depicts a condition of the apparatus when the normal sheets are fed, and FIG. 14 depicts a condition when the thicker sheets are fed.

First of all, explaining the whole construction of the sheet feeding apparatus according to the third embodiment, support plates 53 biased upwardly by means of corresponding bias springs 52 are arranged within a frame 51. A number of normal sheets **54*a* can be stacked on the support plates 53. When sheet supply rollers 55 are rotated in the direction shown by the arrow (FIG. 13), the uppermost sheet is separated from the sheet stack by means of separating claws 56 and is fed to a feeding roller 57**.

Further, thicker sheet guiding side guide members 58 are removably mounted on the corresponding support plates 53. When the thicker sheet **54*b* is fed, by attaching the side guide members 58 onto the corresponding support plates 53, the thicker sheet 54*b* is fed toward the feeding roller 57 while being guided at its lateral edges by the side guide members 58. Each side guide member 58 has a high friction sheet 59 adhered thereon, and the lowermost sheet is pressed against the high friction sheets 59 by means of the separating claws 56**.

Next, explaining each of the constructural elements in detail, the frame 51 is divided into a left half portion **51*a* and a right half portion 51*b*, so that the whole width of the frame can be adjusted in the transverse direction of the sheet by slidably shifting these half portions along a shaft 60. Further, the support plates 53 are mounted on the corresponding left and right half portions 51*a* and 51*b*, and each support plate 53 is biased upwardly by the corresponding bias spring 52, whereby the uppermost sheet in the stacked normal sheets 54*a* supported on the support plates 53 is pressed against the supply rollers 55. Further, each of the left and right frame half portions 51*a*, 51*b* is provided at its lateral outer edge with a normal sheet guiding side guide 61 for guiding one of lateral edges of the normal sheet 54*a*, whereby the both lateral edges of the normal sheet 54*a*** to be fed are guided.

Next, as shown in FIG. 12, the supply rollers 55 are mounted on the shaft 60 to be rotated together with the latter, by disposing a projection **55*a* of each roller 55 into a longitudinal groove 60*a* formed in the shaft 60, the shaft 60 being driven by a motor (not shown) which transmits the rotational force to the shaft 60. The supply rollers 55 can be slid along the shaft 60 so that they can be positioned in place in accordance with the width of the sheets 54*a* or 54*b*** to be stacked.

Figure 16:
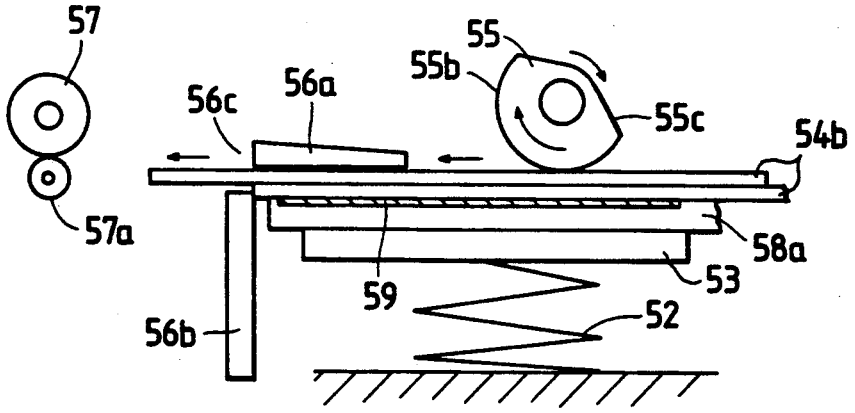
FIG. 16 is a sectional view explaining the feeding of the thicker sheet.

Further, each supply roller 55 has an outer surface constituted by high friction material such as rubber, and is shaped to have an arcuate configuration including an arcuate portion **55*b* and chord portions 55*c* each having a radius smaller than that of the arcuate portion 55*b*, as shown in FIG. 16. When such supply rollers 55 are rotated, the arcuate portions 55*b* are pressed against the sheet 54*a* or 54*b*, whereas the chord portions 55*c* are spaced apart from the sheet 54*a* or 54*b***.

Next, the separating claws 56 will be explained.

In this embodiment, the separating claws 56 are formed integrally with the frame 51, and each separating claw has a pawl portion **56*a* for holding down both corners of the front end of the sheet stack 54*a* or 54*b*, an abutment portion 56*b* against which the front edge of the sheet stack 54*a* or 54*b* is abutted, and a slit 56*c* defined between the pawl portion 56*a* and the abutment portion 56*b*. The slit 56*c* extends up to about a half of a width of the pawl portion 56*a* in the transverse direction, and is so dimensioned that, when the side guide members 58 for the thicker sheet 54*b* are mounted on the support plates 53 and the thicker sheets 54*b* are stacked thereon, the both corners of the front end of the uppermost thicker sheet 54*b* is pressed down by the pawl portions 56*a* of the separating claws 56, but the front end of the uppermost sheet is not abutted against the abutment portions 56b to freely move in the sheet feeding direction through the slits 56c**.

Figure 15:
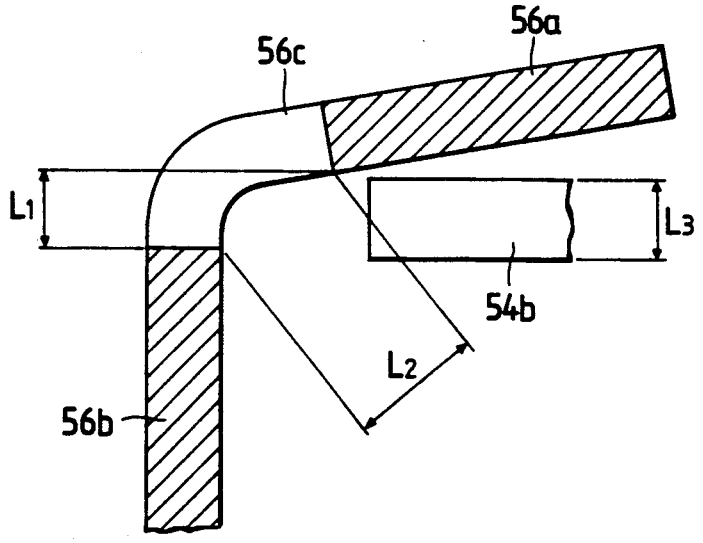
FIG. 15 is a sectional view of a separating claw of the apparatus of FIG. 12.

Further, as shown in FIG. 15, each slit 56c has a width $L_1$ and a distance $L_2$ between the pawl portion 56a and the abutment portion 56b, the distance $L_2$ being greater than the width $L_1$. Further, the width $L_1$ of the slit is smaller than the thickness $L_3$ of the thicker sheet 54b to be fed, and the distance $L_2$ between the pawl portion 56a and the abutment portion 56b is greater than the thickness $L_3$ of the thicker sheet 54b.

Next, the side guide members 58 for the thicker sheet 54b will be explained.

As shown in FIG. 12, the side guide members 58 comprise left and right half portions divided in the same manner as the support plates 53, and each side guide member includes a plate-like support portion 58a for supporting the thicker sheets 54b, and a side guide portion 58b for guiding either lateral edge of the thicker sheets 54b when the thicker sheets are stacked on the support portions 58a. Further, the high friction sheet 59 made of curarine, cork or the like is attached onto each support portion 58a in the substantially whole area thereof.

Each side guide member 58 can be removably mounted on the corresponding support plate 53 by attaching it onto the respective support plate 53 within the frame 51. When the side guide members 58 are mounted on the support plates 53, the left and right side guide portions 58b are set to have a distance smaller than a distance between side guides 61 for guiding the lateral edges of the normal sheet 54a, and a portion of each high friction sheet 59 is positioned below the corresponding separating claw 56.

Next, the operation for feeding the sheet by means of the sheet feeding apparatus constructed as mentioned above will be explained.

First of all, when the normal sheet 54a is fed, as shown in FIG. 13, the side guide members 58 are removed from the corresponding support plates 53, and then the normal sheets 54a are stacked on the support plates 53 in alignment with the side guides 61. In this condition, when the shaft 60 is rotated in the direction shown by the arrow in FIG. 13, the arcuate portions 55b of the supply rollers 55 are rotatingly pressed against the In this case, since the front end of the uppermost sheet 54a is abutted against the abutment portions 56b of the separating claws 56, a loop is formed in the uppermost sheet between the separating claws 56 and the supply rollers 55. When the loop in the sheet grows to some extent, the front end of the uppermost sheet 54a overrides the separating claws 56 due to the hardness to be bent (of the sheet itself), with the result that the uppermost sheet is fed to the feed roller 57.

After the sheet 54a has been pinched between the nip between the feed roller 57 driven by the motor (not shown) and a pinch roller 57a pressed against and driven by the feed roller, the sheet is fed to a predetermined position of the recording portion of the recording system. In this point, the supply rollers 55 are separated from the sheet 54a by opposing their chord portions 55c to sheet 54a.

Next, the feeding of the thicker sheet 54b will be explained. In this case, as shown in FIG. 14, the side guide members 58 for the thicker sheet are mounted on the corresponding support plates 53, and then the thicker sheets 54b are stacked on the side guide members 58 with lateral edges of the sheets being abutted against the side guide portions 58b.

In this condition, when the shaft 60 is rotated, a thrust force is applied to the recording sheet 54b by the arcuate portions 55a of the supply rollers 55, as in the case of the feeding of the normal sheet 54a. In this case, since the dimension of the separating claws 56 is selected as mentioned above, the uppermost thicker sheet 54b is slightly abutted against the abutment portions 56b and then overrides the abutment portions 56b to be fed to the nip between the feed roller 57 and the pinch roller 57a.

Next, the operation when only last two thicker sheets 54b are left after the thicker sheets have been successively fed will be explained. As shown in FIG. 16, the both corners of the front end of the sheets 54b on the support portions 58a of the side guide members 58 are pressed against the separating claws 56 by the bias springs 52 Further, since the support portions 58a situated below the separating claws 56 have the high friction sheets 59 adhered thereon, the both corners of the front end of the lowermost sheet 54b are also pressed against the high friction sheets 59.

Accordingly, even when the supply rollers 55 are separated from the sheet 54b as the sheet 54b is fed by the feed roller 57 and the pinch roller 57a , since the friction force between the lowermost sheet 54b and the high friction sheets 59 is greater than the friction force between the sheets, the last but one sheet 54b can be separated from the lowermost sheet 54b completely, thus preventing a so-called double-feeding.

Incidentally, when the normal sheet 54a is fed, since the side guide members 58 are removed from the apparatus, the normal sheet is not influenced upon the high friction sheets 59.

In the third embodiment, while the arcuate roller was used as each supply roller 55, conventional cylindrical rollers may be used as the supply rollers and it may be so designed that the supply rollers are still contacted with the sheet 54b while the sheet 54b is being fed by the feed roller 57. In this case, it is possible to apply the friction force due to the high friction sheets 59 to the lowermost sheet 54b more effectively, thus preventing the double-feeding more positively.

Further, in the third embodiment, while the high friction sheets 59 were disposed on the respective support portions 58a through the substantially whole area thereof, such high friction sheets 59 may be disposed on the support portions only in the area below the separating claws 56 if the coefficient of friction between the high friction sheets 59 and the recording sheet 54b is greater.

Furthermore, in the third embodiment, while the separating claws 56 were formed integrally with the frame 51, only the pawl portions 56a may be formed integrally with the frame 51, and the abutment portions 56b may be formed as discrete or separate parts and may be attached to the frame by means of screws and the like. In this case, the accuracy of the dimension of the slit 56c which is difficult to obtain by making the claw with a single piece by stamping and bending operation can be easily improved by making the claw with two pieces and by assembling these two pieces to keep the slit dimension with high accuracy.

FIGS. 17–20 show a sheet feeding apparatus according to a fourth embodiment of the present invention. In FIGS. 17–20 showing the fourth embodiment wherein the side guide members 58 in the third embodiment are improved, the same constructural elements as those in the third embodiment are designated by the same reference numerals as used in the third embodiment, and the detailed explanation thereof will be omitted.

Figure 17:
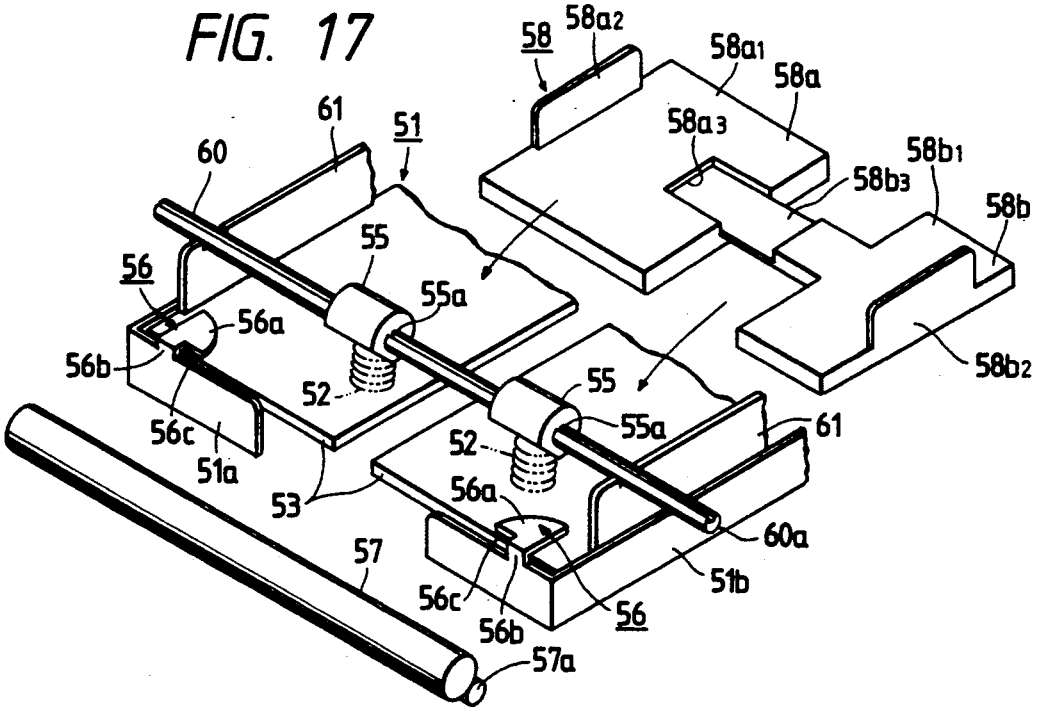
FIG. 17 is an exploded perspective view of a sheet feeding apparatus according to a fourth embodiment of the present invention.
Figure 18:
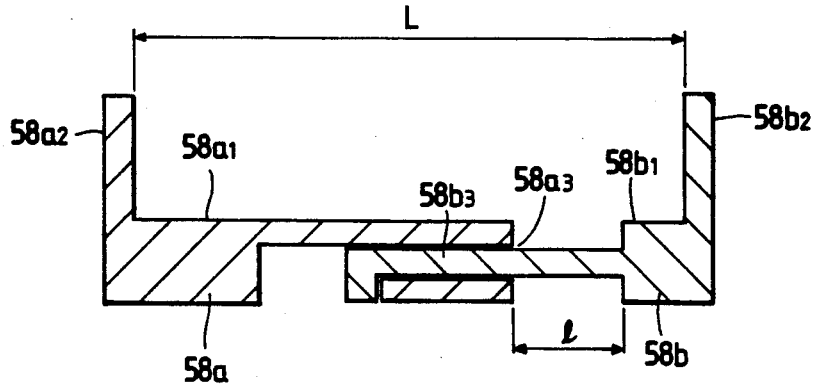
FIG. 18 is a cross sectional view of a thicker sheet guiding side guide of the apparatus of FIG. 17, showing a slidable arrangement thereof.

As shown in FIG. 17, the side guide member 58 comprises a left guide member 58a and a right guide member 58b. The left guide member 58a includes a sheet support portion $58a_1$ and a guide portion $58a_2$ formed on the lateral edge of the sheet support portion. As shown in FIG. 18, a fitting recess $58a_3$ is formed in the sheet support portion $58a_1$. Similarly, the right guide member 58b includes a sheet support portion $58b_1$ and a guide portion $58b_2$ formed on the lateral edge of the sheet support portion. Further, a fitting projection $58b_3$ is formed on the sheet support portion $58b_1$, which projection can be slidably and non-removably fitted into the fitting recess $58a_3$ of the guide member 58a. Accordingly, the distance L between the guide portions $58a_2$ and $58b_2$ of the left and right guide members 58a and 58b can be adjusted by a length l shown in FIG. 18.

Next, the operation when the sheet is fed by the sheet feeding apparatus will be explained.

Figure 19:
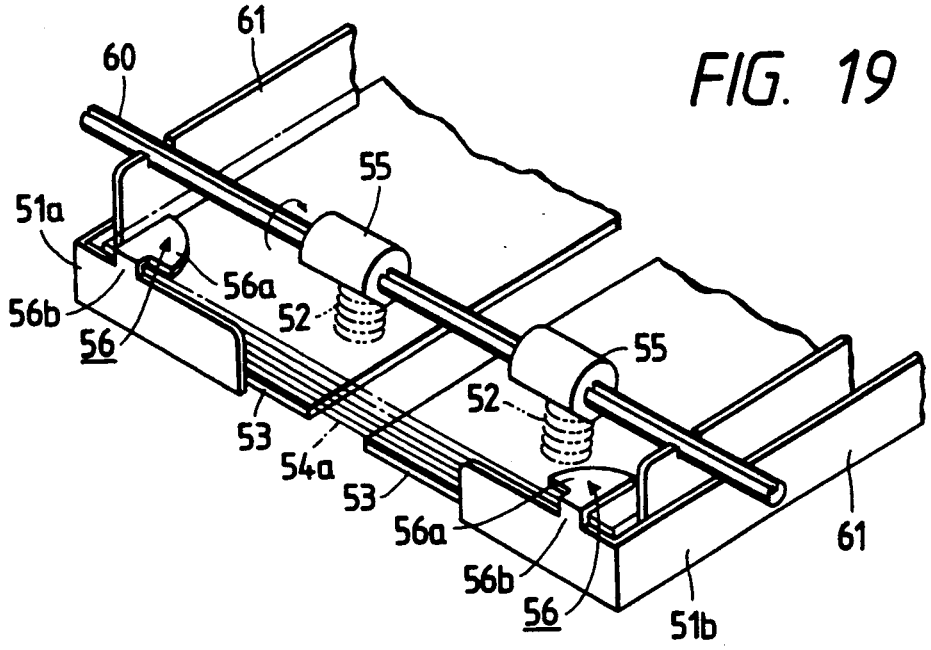
FIG. 19 is a perspective view of the apparatus of FIG. 17, explaining the feeding of the normal sheet.

First of all, when the normal sheet 54a is fed, as shown in FIG. 19, the side guide member 58 is removed from the apparatus, and then the normal sheets 54a are stacked on the support plates 53, and then the side guides 61 are shifted to abut against the lateral edges of the sheet stack. In this condition, when the shaft is rotated in the direction shown by the arrow in FIG. 19, the arcuate portions 55b of the supply rollers are rotatingly pressed against the uppermost sheet a to apply a thrust force to the latter. In this case, since the front end of the uppermost sheet 54a is abutted against the abutment portions 56b of the separating claws 56, a loop is formed in the uppermost sheet between the separating claws 56 and the supply rollers 55. When the loop in the sheet grows to some extent, the front end of the uppermost sheet 54a overrides the separating claws 56 due to the hardness to be bent (of the sheet itself), with the result that the uppermost sheet is fed to the feed roller 57.

After the sheet 54a has been pinched between the nip between the feed roller 57 driven by the motor (not shown) and a pinch roller 57a pressed against and driven by the feed roller, the sheet is fed to a predetermined position of the recording portion of the recording system. In this point, the supply rollers 55 are separated from the sheet 54a by opposing their chord portions 55c to sheet 54a.

Next, the feeding of the thicker sheet 54b will be explained.

Figure 20:
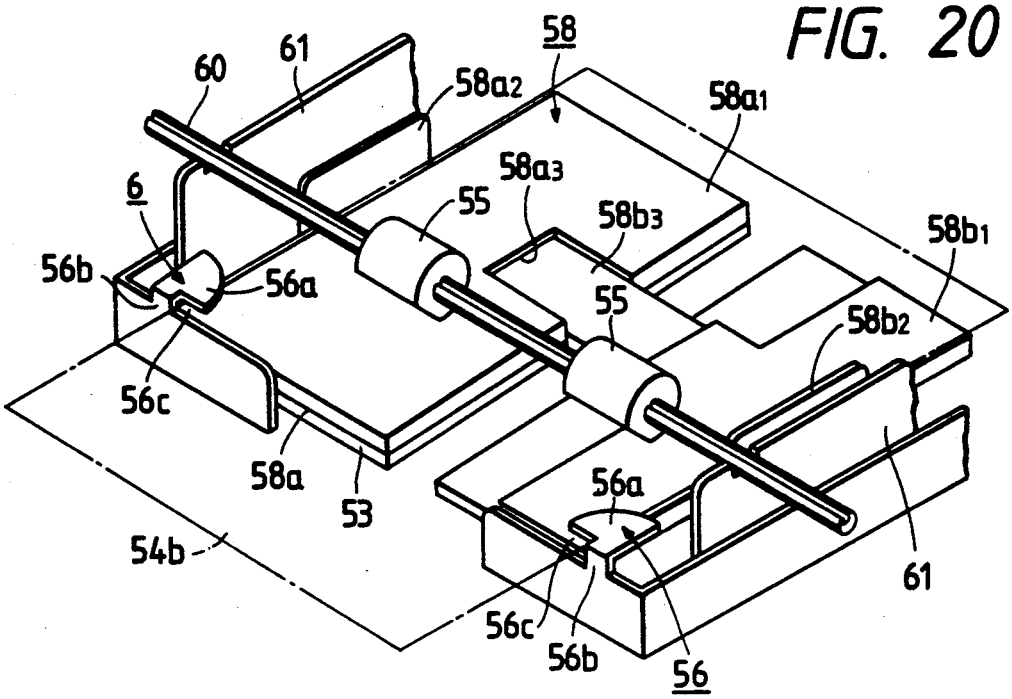
FIG. 20 is a perspective view of the apparatus of FIG. 17, explaining the feeding of the thicker sheet.
Figure 21A:
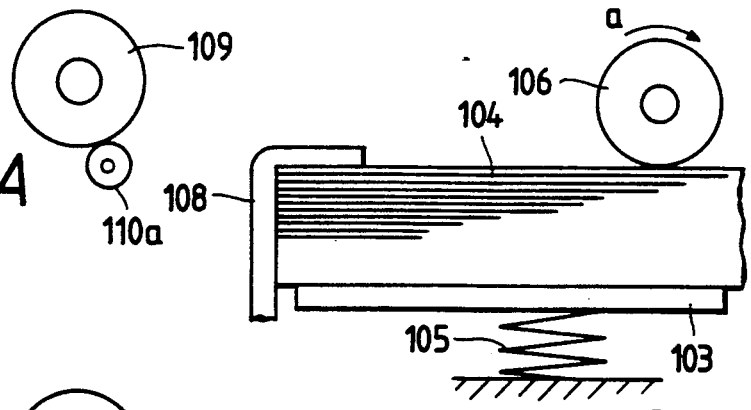
FIGS. 21A to 21D show the sheet feeding steps in a sheet feeding apparatus according to a fifth embodiment of the present invention.
Figure 21B:
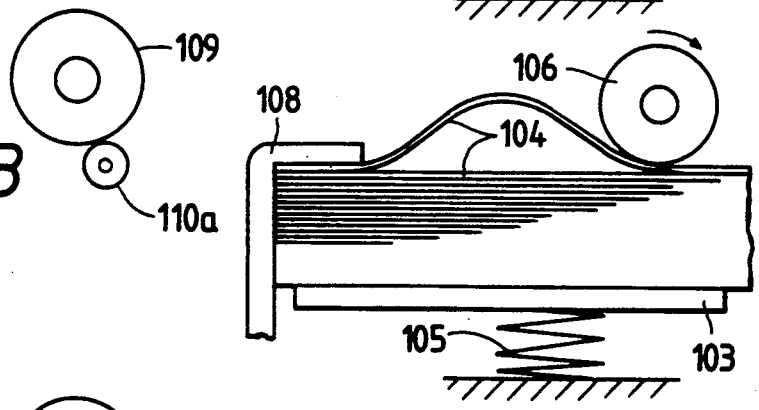
Figure 21C:
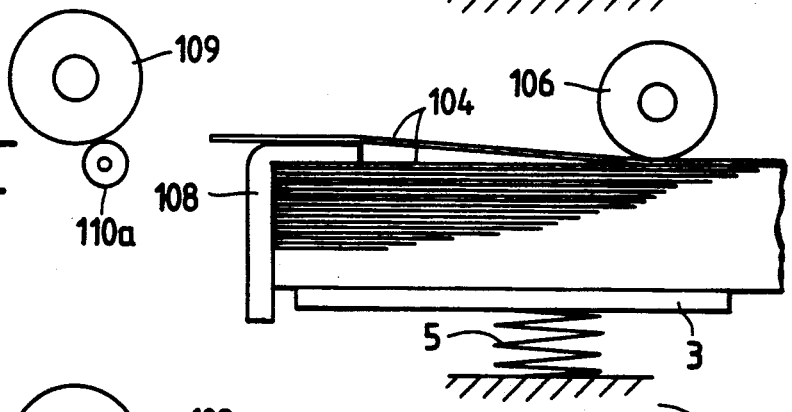
Figure 21D:
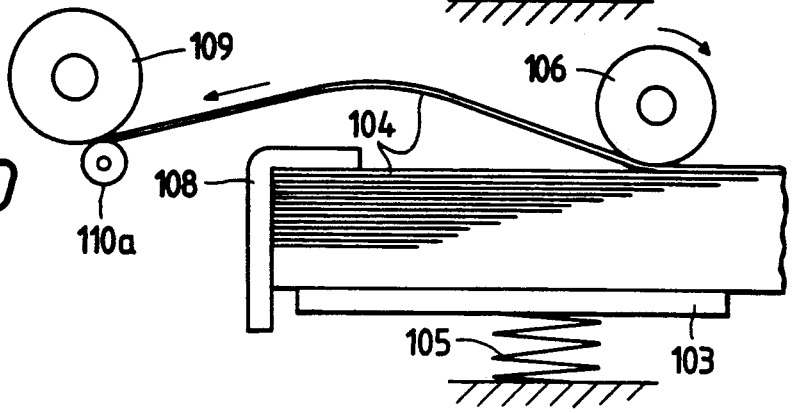

In this case, as shown in FIG. 20, the side guide member 58 for the thicker sheet is mounted on the corresponding support plates 53, and then the thicker sheets 54b are stacked on the support portions $58a_1$, $58b_1$ of the side guide member 58, and then the right guide portion $58b_2$ is shifted toward the left guide portion $58a_2$ to abut these guide portions $58a_2$, $58b_2$ against the lateral edges of the stacked thicker sheets 54b. In this case, the side guide member 58 is positioned so that the thicker sheet 54b fed from the side guide member 58 can pass through the slits 56c of the separating claws 56.

In this condition, when the shaft 60 is rotated, a thrust force is applied to the recording sheet 54b by the arcuate portions 55a of the supply rollers 55, as in the case of the feeding of the normal sheet 54a. In this case, since the dimension of the separating claws 56 is selected as mentioned above as shown in FIG. 9, the uppermost thicker sheet 54b is slightly abutted against the abutment portions 56b and then overrides the abutment portions 56b to be fed to the nip between the feed roller 57 and the pinch roller 57a through the slits 56c of the separating claws 56.

As mentioned above, by adjusting the distance between the guide portions 58a and $58b_2$ of the side guide member 58, the lateral edges of the thicker sheet 54b can be guided without fail, thus preventing the thicker sheets 54b from disengaging from the pawl portions 56a of the separating claws 56 due to the play between the thicker sheets 54b and the guide portions $58a_2$, $58b_2$, thereby avoiding the erroneous feeding of the sheet.

Further, since the left guide member 58a is non-removably connected to the right guide member 58b, the side guide member 58 is constituted as a side guide unit, thus facilitating the mounting of the side guide member on the support plates 53 and preventing the separation between the left and right guide members.

Incidentally, in the fourth embodiment, while the arcuate roller was used as each supply roller 55, conventional cylindrical rollers may be used as the supply rollers. Further, in the fourth embodiment, while the separating claws 56 were formed integrally with the frame 51, only the pawl portions 56a may be formed integrally with the frame 51, and the abutment portions 56b may be formed as discrete or separate parts and may be attached to the frame by means of screws and the like. In this case, the accuracy of the dimension of the slit 56c which is difficult to obtain by making the claw with a single piece by stamping and bending operation can be easily improved by making the claw with two pieces and by assembling these two pieces to keep the slit dimension with high accuracy.

Next, a fifth embodiment of the present invention will be explained with reference to FIGS. 21 to 24.

Figure 22:
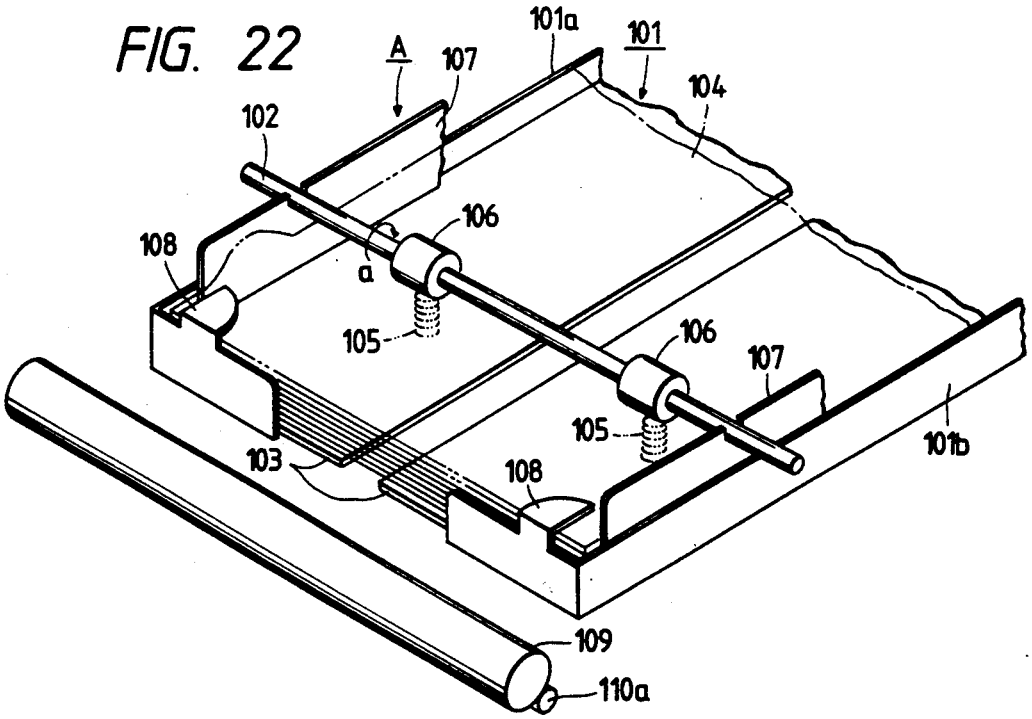
FIG. 22 is a perspective view of the sheet feeding apparatus of FIG. 21.
Figure 23:
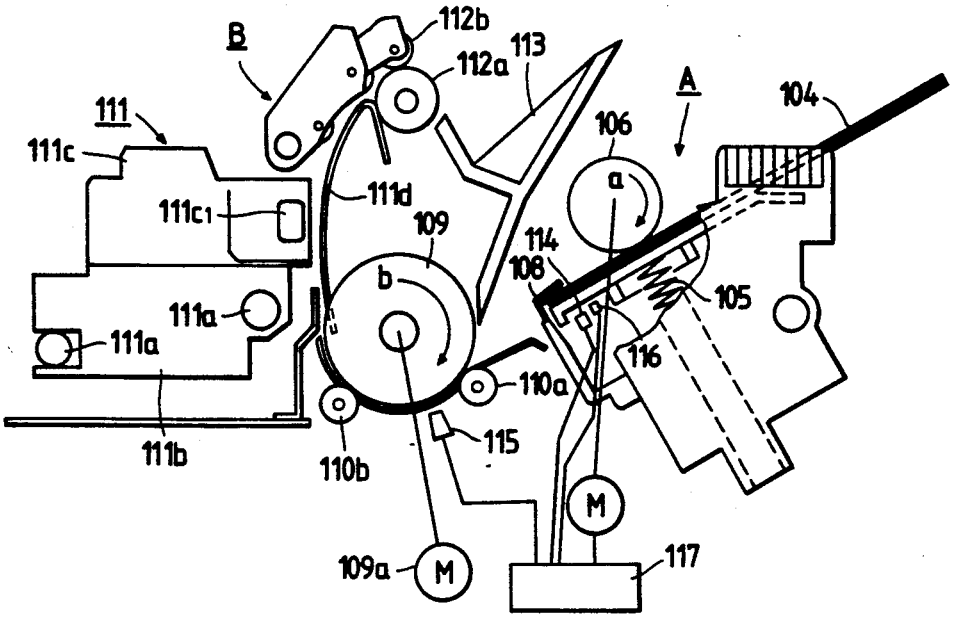
FIG. 23 is a schematic constructural view of a recording system using the sheet feeding apparatus of FIG. 22.

FIGS. 21A to 21D show sheet feeding steps performed by a sheet feeding apparatus according to the fifth embodiment, FIG. 22 shows a construction of the sheet feeding apparatus, and FIG. 23 shows a recording system using the sheet feeding apparatus.

As shown in FIGS. 22 and 23, the sheet feeding apparatus A comprises a frame 101 divided into a left half portion 101a and a right half portion 101b, so that the whole width of the frame can be adjusted by shifting these half portions along a shaft 102.

A number of recording sheets 104 are supported, in a stack, on support plates 103 arranged within the frame 101. The upper surface of the sheet stack on the support plates is pressed against supply rollers 106 fixed to the shaft 102 by biasing the support plates 103 toward the supply rollers 106 by means of bias springs 105.

Side guides 107 for guiding the lateral edges of the recording sheets 104 are arranged on side walls of the left and right frame half portions 101a and 101b, respectively. On an outer side of a front end of each of the frame half portions 101a and 101b, separating claws 108 are provided, respectively, for separating the uppermost sheet 104 from the sheet stack during the sheet feeding operation. Accordingly, when the supply rollers 106 are rotated in the direction shown by the arrow a (FIG. 22) by means of a feed motor 106a, a thrust force is applied to the uppermost recording sheet 104 due to the friction force of the supply rollers 106. Consequently, the leading or front end of the uppermost recording sheet 104 is abutted against the separating claws 108 and is stopped thereby, with the result that a loop is formed in the uppermost recording sheet 104, thereby separating the uppermost recording sheet from the sheet stack and feeding the separated recording sheet.

Incidentally, a feed roller 109 acting as a feeding means is arranged in front of the separating claws 108 in the sheet feeding direction. The recording sheet 104 separated by the separating claws 108 is fed to the feed roller 109 after it is stopped by a predetermined time period, and, thereafter, the recording sheet is fed by the feed roller 109.

The recording sheet 104 separated and fed by the sheet feeding apparatus A reaches a recording system B as shown in FIG. 23, where a predetermined image is recorded on the recording sheet.

Explaining the construction of the recording system B, pinch rollers 110*a*, 110*b* are pressed against the feed roller 109, which pinch rollers are rotatingly driven by the rotation of the feed roller 109. Accordingly, the recording sheet 104 pinched between the feed roller 109 and the pinch roller 110*a* is fed by the feed roller 109 rotated in the direction shown by the arrow b (FIG. 23) by means of the feed motor 109*a* to the recording means 111, by which the predetermined image is recorded on the recording sheet.

In the illustrated embodiment, the recording means 111 utilizes an ink jet recording technique. To this end, an ink jet recording head 111*c* is mounted on a carriage 111*b* shiftable along guide rods 111*a* by means of a carriage motor (not shown), and a row of ink discharge nozzles $111c_1$ extending in the longitudinal direction are arranged on the ink jet recording head 111*c*. Accordingly, by discharging the ink from the ink discharge nozzles $111c_1$ in response to an image signal in synchronous with the movement of the carriage 111*b*, the predetermined image can be recorded on the recording sheet 104.

Incidentally, the reference numeral 111*d* designates a plate-shaped platen incorporating a heater therein and thermally adjusted to have the temperature of about 60° C., for example. This platen serves to dry the ink discharged onto the recording sheet 104. The recording sheet 104 on which the image has been recorded by the recording means 111 is ejected into a stacker 113 by means of an ejector roller 112*a* and a spur roller 112*b* pressed against the ejector roller to be driven thereby.

Incidentally, the sheet feeding apparatus A includes a sheet presence/absence sensor 114 provided in the vicinity of the frame 101 for detecting whether the recording sheet 104 exists on the support plates 103 or not, and a sheet detecting sensor 115 provided in a predetermined position between the pinch rollers 110*a* and 110*b* for detecting the leading end of the recording sheet 104. Further, in the illustrated embodiment, a size detecting sensor 116 is also provided for detecting the position of the side guides 107 to determine the size of the recording sheet. In the illustrated embodiment, the sensor 116 has a function for detecting the thickness of the recording sheet, and, for example, detects the difference in thickness between the normal sheet and the thicker sheet (postcard and the like) as the difference in size.

Figure 24:
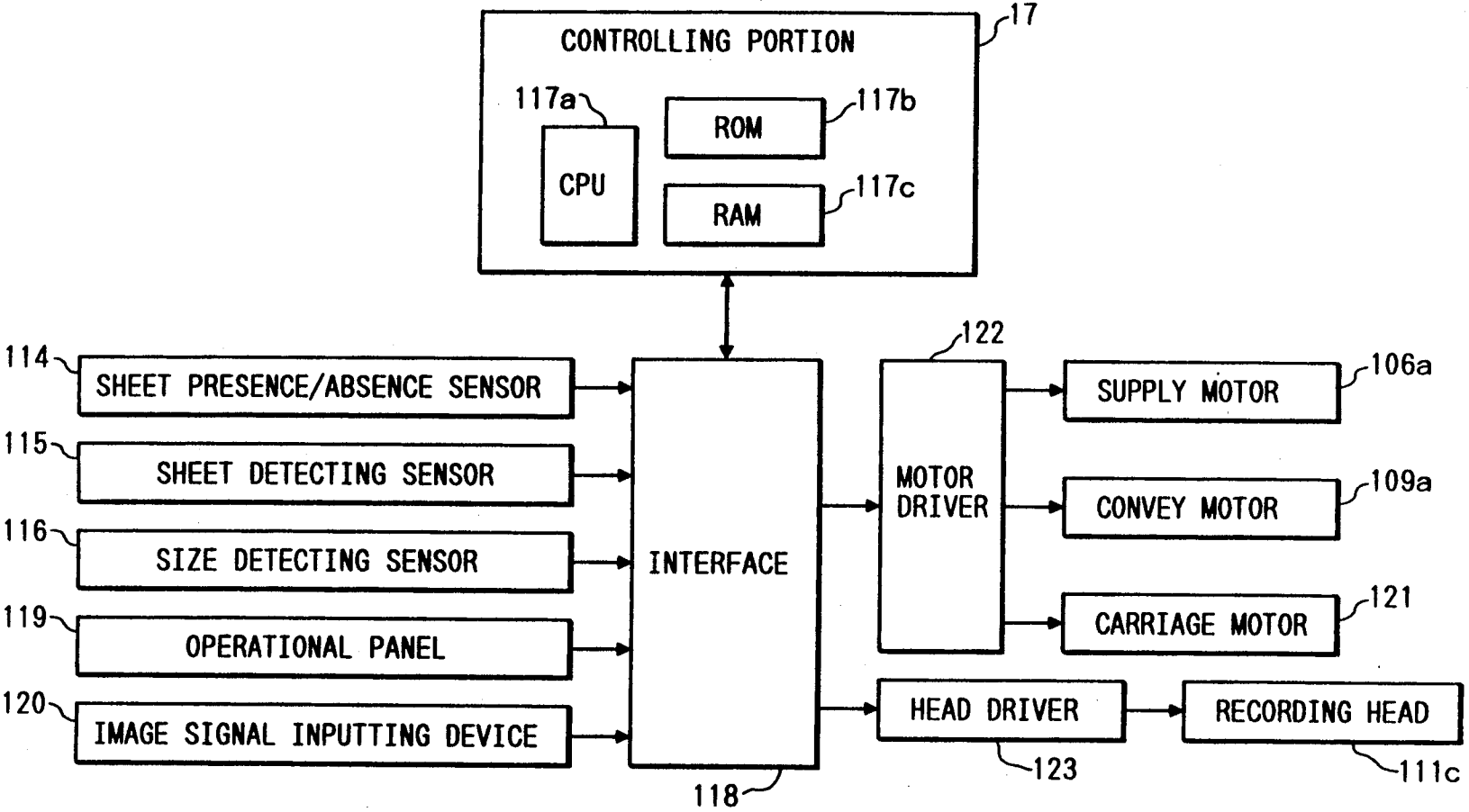
FIG. 24 is a control block diagram for the sheet feeding apparatus.

A control system for drivingly controlling the sheet feeding apparatus A and the recording system B is designed as shown in a block diagram of FIG. 24.

Figures 25, 25A:
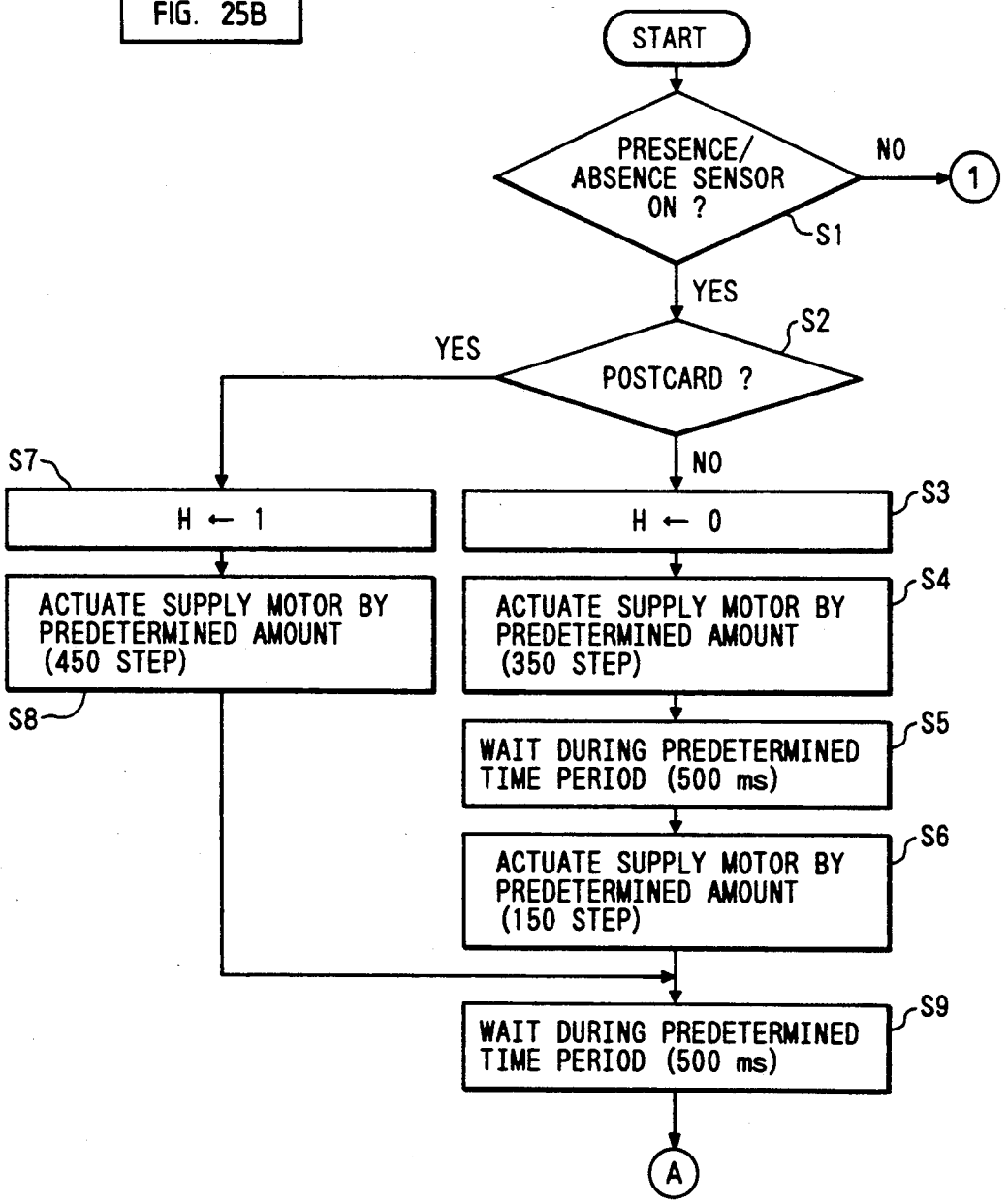
FIGS. 25, 25A and 25B are a flow chart showing a sheet feeding sequence.
Figure 25B:
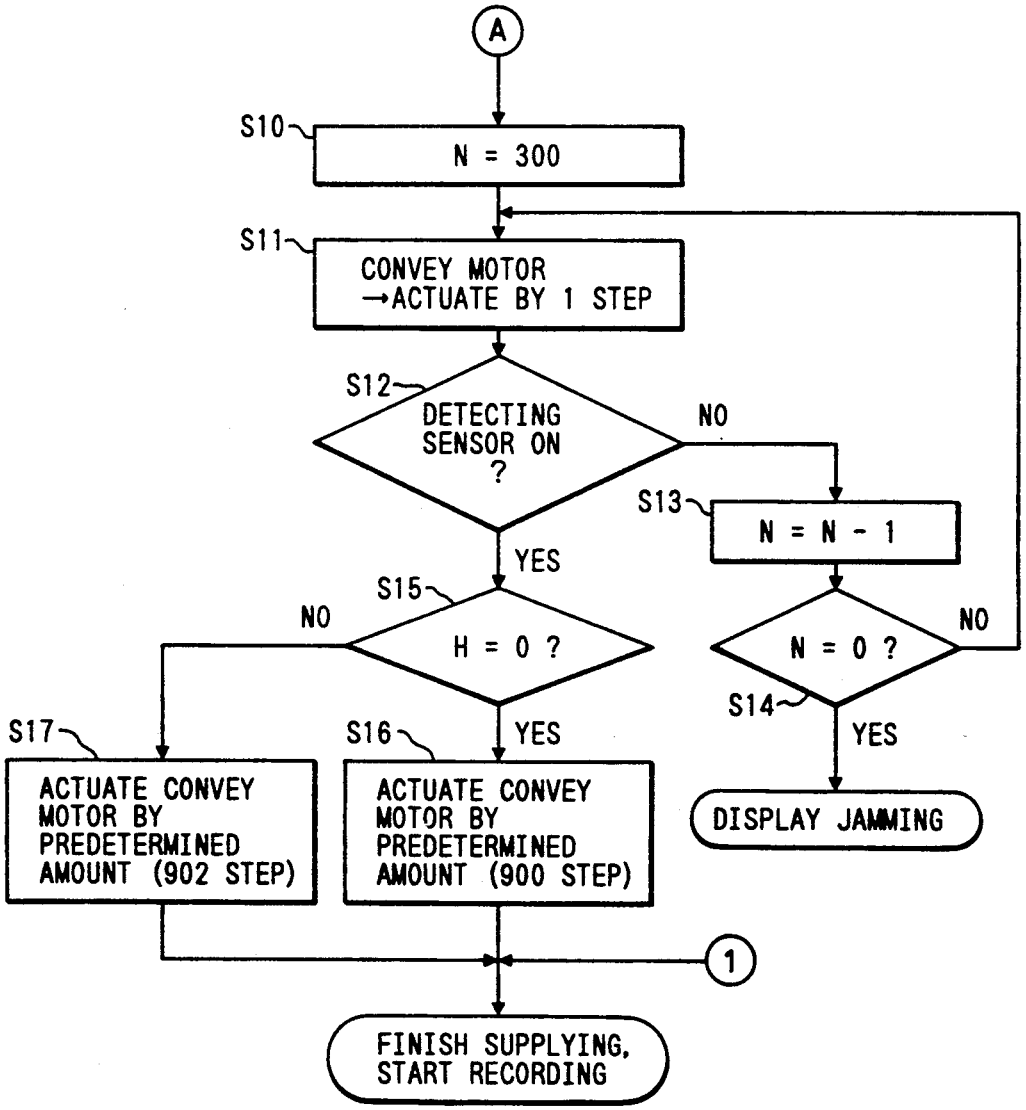
Figure 26:
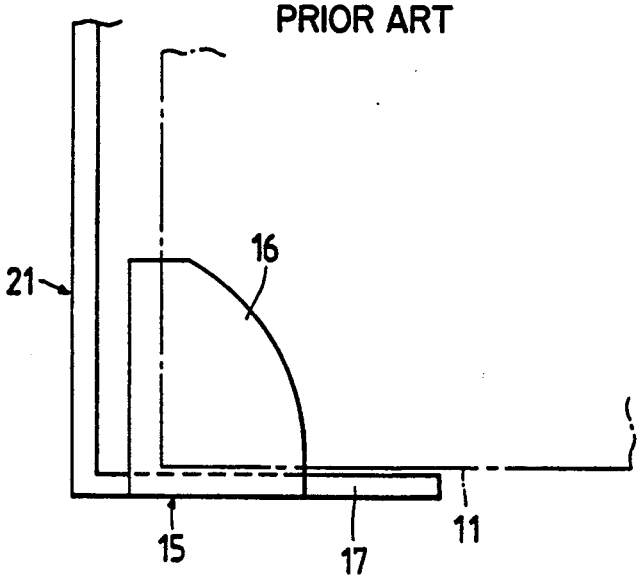
FIG. 26 PRIOR ART
FIG. 26 is a plan view of a separating claw in a conventional sheet feeding apparatus.
Figure 27:
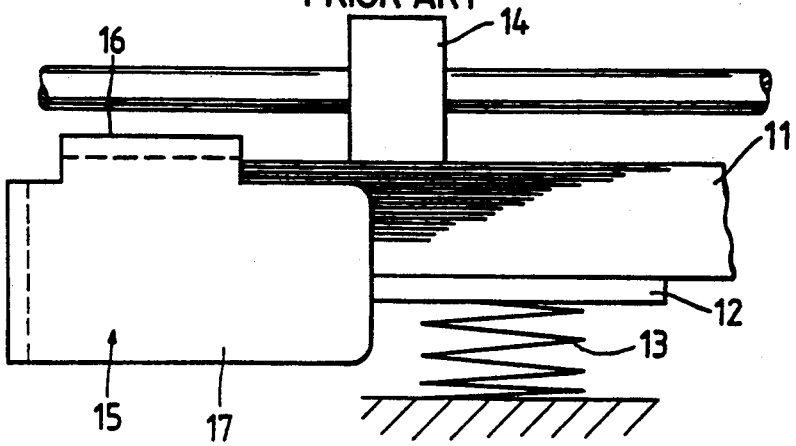
FIG. 27 PRIOR ART
FIG. 27 is an elevational view of the separating claw of FIG. 26.

More particularly, the control system includes a controlling portion 117 having a CPU 117*a* such as a microprocessor and the like, a ROM 117*b* for storing a control program for actuating the CPU 117*a* in accordance with a sequence shown in a flow chart of FIG. 25 and other various data, and a RAM 117*c* used as a work area of the CPU 117*a* and used for temporarily storing the various data. The controlling portion 117 can receive signals from an operational panel 119 having a record start switch and the like, the sheet presence/absence sensor 114, the sheet detecting sensor 115, the size detecting sensor 116 and an image signal inputting device 120, through an interface 118. Further, the controlling portion 117 outputs signals, through the interface 118, to the feed motor 106*a*, the convey motor 109*a*, a motor driver 122 for driving the carriage motor 121, and a head driver 123 for driving the recording head 111*c*.

Next, a sequence for feeding the recording sheet 104 by means of the sheet feeding apparatus A will be explained. Incidentally, in this example, it is assumed that a postcard is used as the thicker sheet, and a plain paper having, for example, A4 size different from the postcard in size is used as the normal sheet.

As shown in the flow chart of FIG. 25, when the record start switch is activated, in a step S1, the sheet presence/absence sensor 114 detects whether the recording sheet 104 exists on the support plates 103 or not; if the recording sheet 104 is present, i.e., if the sensor 114 is turned ON, the sequence goes to a step S2, where the size detecting sensor 116 detects whether the sheet to be fed is the plain paper or postcard; if the plain paper, the sheet is fed in accordance with a normal sheet feeding mode.

That is to say, the sequence goes to a step S3, where a sheet kind variable H is set to "0", and then the sequence goes to a step S4, where the supply motor 106*a* is actuated by a predetermined amount (for example, 350 steps) to separate only one recording sheet 104. The actuated amount of the supply motor 106*a* from the initiation of rotation of the supply motor 106*a* (condition shown in FIG. 21A) is so selected that the loop is formed in the uppermost recording sheet 104 between the separating claws 108 and the supply rollers 106 (condition shown in FIG. 21B), and then the leading end of the uppermost recording sheet is completely separated from the separating claws 108 due to the hardness to be bent, but the separated sheet does not reach the feed roller 109 (condition shown in FIG. 21C).

Next, in a step S5, the supply motor 106*a* is stopped for a predetermined time period (for example, 500 ms) in the above condition, thus stopping the feeding of the recording sheet 104 temporarily. In this way, the recording sheet 104 which was in an unstable condition immediately after the separation thereof will be in a stable condition. Then, the sequence goes to a step S6, where the supply motor 106*a* is actuated by a predetermined amount (for example, 150 steps). This predetermined amount is so selected that the leading end of the recording sheet 104 is abutted against the feed roller 109 and the pinch roller 110*a* thereby to form the loop in the recording sheet (condition shown in FIG. 21D).

In the prior art, since the step S2 and the step S4 was combined (i.e., in this example, the supply motor 106*a* was continuously actuated by 500 steps), the recording sheet 104 which was in the unstable condition immediately after the separation thereof was fed as it was. To the contrary, in the illustrated embodiment, the feeding of the recording sheet is stopped temporarily to restore the recording sheet in the stable condition, and thereafter, the recording sheet is fed to the feed roller 109. Then, the sequence goes to a step S9.

Incidentally, in the step S2, if it is judged that the recording sheet 104 is the postcard, the recording sheet is fed in accordance with the thicker sheet feeding mode.

That is to say, the sequence goes to a step S7, where the sheet kind variable H is set to "1", and, then, in a step S8, the supply motor 106 is actuated by a predetermined amount (for example, 450 steps). Thereafter, the sequence goes to the step S9. The predetermined amount of the actuation of the motor in the step S8 is the same as in the case of the feeding of the normal sheet in the point that only the uppermost recording sheet is separated by the separating claws 108, but, is so selected that the supply motor 106a is continuously rotated to abut the leading end of the recording sheet against the nip between the feed roller 109 and the pinch roller 110a and to form the loop in the recording sheet 104 between the nip and the supply rollers 106.

Incidentally, in this example, the actuation amount of the supply motor 106a for feeding the plain paper to the nip is 500 steps in total, whereas the actuation amount of the supply motor for feeding the postcard to the nip is 450 steps in total, and, thus, is smaller than the former. The reason is that the loop formed in the postcard may be smaller than formed in the plain paper.

After the leading end of the recording sheet 104 has been abutted against the nip between the feed roller 109 and the pinch roller 110a and the loop has been formed in the recording sheet, in the step S9, the supply motor 106a is stopped for a predetermined time period (for example, 500 ms), thus stabilizing the loop formed in the recording sheet 104 between the nip and the supply rollers 106.

Then, in steps S10–S14, the feed motor 109a is actuated step-by-step, and, each time, the leading end of the recording sheet 104 is detected by the sheet detecting sensor 115. During a predetermined feeding amount (for example, 300 steps), if the sensor does not detect the leading end of the recording sheet, i.e., if the sensor 115 is not turned ON, it is judged that the jamming of the sheet occurs, and the jamming condition is indicated on the operational panel 119.

On the other hand, while the feed motor 109a is actuated for the above 300 steps, if the sheet detecting sensor 115 detects the leading end of the recording sheet, the sequence goes to a step S15, where it is judged whether the fed recording sheet 104 is the plain paper or postcard on the basis of the sheet kind variable; if the plain paper, the sequence goes to a step S16, where the feed motor 109a is actuated by a predetermined amount (for example, 900 steps) after the sensor 115 has been turned ON, thus feeding the recording sheet to the recording means 111, thereby finishing the sheet feeding operation and starting the recording operation. On the other hand, in the step S15, if it is judged that the fed sheet 104 is the postcard, the sequence goes to a step S17, where the feed motor 109a is actuated by a predetermined amount (for example, 902 steps) after the sensor 115 has been turned ON, thus feeding the recording sheet to the recording means 111, thereby finishing the sheet feeding operation and starting the recording operation.

The reason why the actuation amount of the convey motor 109a in case of the plain paper (900 steps) differs from that in the case of the postcard (902 steps) is that the difference in the detection timings of the sheet detecting sensor 115 and/or the conveying (or feeding) loads due to the difference in the hardness to be bent (of the sheet) caused by the difference in thickness of the respective sheets should be corrected.

As mentioned above, by discriminating the plain paper and the postcard and by feeding the respective sheets in the optimum mode, the feeding of the sheet in the unstable condition is prevented in the case of the plain paper, and the meaningless stop of the motor is avoided not to reduce the through-top of the recording time in case of the postcard. Further, even if there is the difference in the amount of the loop and/or heading amount of the recording sheet due to the difference in thickness, it is possible to feed the respective recording sheets in the optimum mode by adopting the correction values in accordance with the kinds of sheets.

Incidentally, the sheet feeding amounts and the waiting times shown in the above-mentioned example are merely exemplified, and, thus, these values may be appropriately changed in accordance with the dimension of the sheet feeding apparatus and the like. For example, the longer the distance between the separating claws 108 and the nip between the feed roller 109 and the pinch roller 110a, the shorter the sheet waiting time be possible; on the other hand, when such distance is shorter or when it is relatively difficult to separate the sheet 104 from the separating claws, such sheet waiting time may be longer.

Further, the rotation speed of the supply motor 106a may be so selected that the motor is rotated at a normal speed until the recording sheet is separated, and thereafter, the motor is rotated at a slower speed, whereby the loop in the recording sheet 104 is more stably formed between the feed roller 109 and the supply rollers 106.

Further, in the above example, while the sensor acting as the discriminating means judged whether the recording sheet is the plain paper or the postcard on the basis of the difference in sheet size; however, in a word-processor and the like, an operator previously designates the size of the sheet to write a composition and a host computer transmits the writing contents to the controlling portion of the recording system and sends information regarding the recording sheet. Accordingly, in this case, it may be judged whether the recording sheet is the plain paper or the postcard on the basis of such sheet information to select the sheet feeding mode.

Further, in place of the sheet size, the recording sheet may be discriminated, for example by using an optical sensor. More particularly, the light from the optical sensor is illuminated onto the sheet 104 to be fed, and, when the thickness of the sheet is for example about 100 μm or less (normal sheet) the light pass through the sheet 104 to turn the sensor ON and when the thickness of the sheet is about 200 μm (thicker sheet) the light is interrupted by the sheet to turn the sensor OFF, whereby it is judged whether the recording sheet is the normal sheet or the thicker sheet.

Alternatively, a selection switch for inputting either the normal sheet information or the thicker sheet information may be provided on the operational panel 119, so that the recording sheet can be discriminated on the basis of the information selected by the operator.

Further, in the illustrated embodiments, while the supply rollers 106 and feed roller 109 were used as supplying means and conveying means, these means are not limited to the cylindrical rollers, but may be constituted by a rotating endless belt and the like.

Furthermore, the sheet feeding apparatuses according to the first, second, third and fourth embodiments can be applied to the recording system shown in FIG. 23.

In the above-mentioned first to fifth embodiments, while the thicker sheet guiding side guide 25 were removable, shiftable or retractable, alternatively, the normal sheet guiding side guides 24 may be removable or shiftable. Further, the position of the thicker sheet guiding side guides may be regulated by the normal sheet guiding side guides. In addition, the position of the separating claws may be changed independently of the side guides. With this arrangement, by aligning the slits with the sheet, any thicker sheets can be separated by the slits. Further, the separating claw and side guide may be arranged only at one side of the sheet.

I claim:

1. A sheet feeding apparatus comprising support means on which sheets are supported in a sheet stack;

at least one separating claw arranged adjacent a corner of a front end of the sheet stack supported on said support means and having a pawl portion for abutting an upper surface of the sheet stack and an abutment portion against which the front end of the sheet stack is abutted;

a slit provided between said pawl portion and said abutment portion of said separating claw, for permitting the passage of only one sheet having a predetermined thickness;

guide means for selectively positioning lateral edges of the sheet stack supported on said support means between a first position where an uppermost sheet on the sheet stack can pass through said slit and a second position where the uppermost sheet is blocked by said separating claw; and supply means for feeding the sheet stacked on said support means.

2. A sheet feeding apparatus according to claim 1, wherein said separating claw has a connecting portion connecting between said pawl portion and said abutment portion.

3. A sheet feeding apparatus according to claim 2, wherein, when the lateral edges of the sheet stack are positioned in said first position by said guide means, a leading end of the uppermost sheet opposes to said slit, but does not oppose to said connecting portion.

4. A sheet feeding apparatus according to claim 3, wherein, when the lateral edges of the sheet stack are positioned in said second position by said guide means, the leading end of the uppermost sheet opposes to said connecting portion.

5. A sheet feeding apparatus according to claim 1, wherein said guide means comprises a first guide member for positioning the lateral edges of the sheet stack in said first position, and a second guide member for positioning the lateral edges of the sheet stack in said second position.

6. A sheet feeding apparatus according to claim 5, wherein at least one of said first and second guide members is removable with respect to a frame of the sheet feeding apparatus.

7. A sheet feeding apparatus according to claim 5, wherein at least one of said first and second guide members is shiftable with respect to a frame of the sheet feeding apparatus.

8. A sheet feeding apparatus according to claim 7, wherein said first guide member is shiftable in accordance with a size of the sheets to be stacked.

9. A sheet feeding apparatus according to claim 5, wherein at least one of said first and second guide members is retractable with respect to said support means.

10. A sheet feeding apparatus according to claim 5, wherein said first guide member is supported by a support member arranged on said support means.

11. A sheet feeding apparatus according to claim 10, wherein said support member has a support surface on which the sheets are stacked.

12. A sheet feeding apparatus according to claim 11, wherein a friction surface for applying a friction force to the sheet is formed on said support surface in confronting relation to said separating claw.

13. A sheet feeding apparatus according to claim 5, wherein said first guide member has a pair of guide portions for guiding the lateral edges of the sheet, said guide portions being shiftable in a transverse direction of the sheet.

14. A sheet feeding apparatus according to claim 1, wherein said slit is formed by cutting portions of said separating claw, which portions oppose to a leading end of the sheet and to an upper surface of the sheet.

15. A sheet feeding apparatus according to claim 14, wherein said slit has a width $L_1$, and distance $L_2$ between said pawl portion and said abutment portion, said distance $L_2$ being larger than said width $L_1$.

16. A sheet feeding apparatus according to claim 15, wherein said width $L_1$ and distance $L_2$ are selected that a thickness of the sheet positioned in said first position by said guide means is larger than the width $L_1$ and smaller than the distance $L_2$.

17. A sheet feeding apparatus according to claim 1, further including control means for controlling said supply means in such a manner that, when the lateral edges of the sheet stack are positioned in said second position, the feeding of the sheet is stopped after the sheet is separated, and then is started again after a predetermined waiting time has been elasped.

18. A sheet feeding apparatus according to claim 17, further including detecting means for detecting the thickness of the sheet.

19. A sheet feeding apparatus according to claim 1, wherein said guide means regulates at the first position sheets which are thicker than the sheets regulated at the second position.

20. A recording system comprising:

support means on which sheets are supported in a sheet stack;

at least one separating claw arranged adjacent a corner of a front end of the sheet stack supported on said support means and having a pawl portion for abutting an upper surface of the sheet stack and an abutment portion against which the front end of the sheet stack is abutted;

a slit provided between said pawl portion and said abutment portion of said separating claw, for permitting the passage of only one sheet having a predetermined thickness;

guide means for selectively positioning lateral edges of the sheet stack supported on said support means between a first position where an uppermost sheet on the sheet stack can pass through said slit and a second position where the uppermost sheet is blocked by said separating claw;

supply means for feeding the sheet stacked on said support means; and recording means for recording an image on the sheet fed by said supply means.

21. A sheet feeding apparatus comprising:

support means on which sheets are supported in a sheet stack;

at least one separating claw arranged adjacent a corner of a front end of the sheet stack supported on said support means, said separating claw having a pawl portion for abutting an upper surface of the sheet stack and an abutment portion against which the front end of the sheet stack is abutted for separating one sheet by bending a front end of the sheet and causing it to ride over the pawl portion, a lit provided between said pawl portion and said abutment portion of said separating claw for separating one sheet by permitting the passage of only one sheet; and guide means for positioning lateral edges of the sheet stack supported on said support means.

22. A sheet feeding apparatus comprising:

support means on which sheets are supported in a sheet stack;

at least one separating claw with said arranged adjacent a corner of a front end of the sheet stack supported on said support means, said separating claw having a pawl portion for abutting an upper surface of the sheet stack and an abutment portion against which the front end of the sheet stack is abutted for separating one sheet by bending a front end of the sheet and causing it to ride over the pawl portion, said pawl portion and said abutment portion of said separating claw for separating one sheet by permitting the passage of only one sheet;

guides means for positioning lateral edges of the sheet stack supported on said support means; and supply means for feeding the sheet stacked on said support means.

23. A sheet feeding apparatus comprising:

support means on which sheets are supported in a sheet stack;

at least one separating claw arranged adjacent a corner of a front end of the sheet stack supported on said support means and having a pawl portion for abutting an upper surface of the sheet stack and an abutment portion against which the front end of the sheet stack is abutted;

a slit provided between said pawl portion and said abutment portion of said separating claw for permitting the passage of only one sheet having a predetermined thickness; and guide means for selectively positioning lateral edges of the sheet stack supported on said support means between a first position where an uppermost sheet on the sheet stack can pass through said slit and a second position where the uppermost sheet is blocked by said separating claw.

* * * * *

UNITED STATES PATENT AND TRADEMARK OFFICE

CERTIFICATE OF CORRECTION

PATENT NO. : 5,145,164

DATED : September 8, 1992

INVENTOR(S) : SHOICHI KAN

It is certified that error appears in the above-identified patent and that said Letters Patent is hereby corrected as shown below:

COLUMN 2

Line 65, "at" should be deleted.

COLUMN 4

Line 4, "at" should be deleted.

COLUMN 7

Line 18, "width o" should read --width α--.
Line 21, "thickness 65" should read --thickness γ--.

COLUMN 8

Line 66, "is" should read --are--.

COLUMN 9

Line 45, "the In" should read --the uppermost sheet 54a to apply a thrust force to the latter. In--.

UNITED STATES PATENT AND TRADEMARK OFFICE

CERTIFICATE OF CORRECTION

PATENT NO. : 5,145,164

DATED : September 8, 1992

INVENTOR(S) : SHOICHI KAN

It is certified that error appears in the above-identified patent and that said Letters Patent is hereby corrected as shown below:

COLUMN 10

Line 17, "springs 52" should read --springs 52.--

COLUMN 13

Line 29, "are" should read --is--.

COLUMN 18

Line 25, "that" should read --so that--.
Line 35, "been" should be deleted.

COLUMN 19

Line 9, "lit" should read --slit--.

Signed and Sealed this

Ninth Day of November, 1993

Bruce Lehman

*Attest:*

BRUCE LEHMAN

*Attesting Officer*

*Commissioner of Patents and Trademarks*